US011173587B2

(12) United States Patent
Hack

(10) Patent No.: US 11,173,587 B2
(45) **Date of Patent: *Nov. 16, 2021**

(54) SOCKET APPARATUS

(71) Applicant: Timothy L. Hack, Morgantown, KY (US)

(72) Inventor: Timothy L. Hack, Morgantown, KY (US)

( * ) Notice: Subject to any disclaimer, the term of this patent is extended or adjusted under 35 U.S.C. 154(b) by 44 days.

This patent is subject to a terminal disclaimer.

(21) Appl. No.: 16/928,399

(22) Filed: Jul. 14, 2020

(65) Prior Publication Data

US 2020/0338701 A1 Oct. 29, 2020

Related U.S. Application Data

(63) Continuation of application No. 16/569,012, filed on Sep. 12, 2019, which is a continuation of application No. 13/206,789, filed on Aug. 10, 2011, now Pat. No. 10,442,062, which is a continuation-in-part of application No. 11/925,447, filed on Oct. 26, 2007, now Pat. No. 7,997,169, which is a continuation-in-part of application No. 11/403,356, filed on Apr. 13, 2006, now abandoned.

(51) Int. Cl.
*B25B 23/00* (2006.01)
*B25B 13/06* (2006.01)

(52) U.S. Cl.
CPC ..... *B25B 23/0021* (2013.01); *B25B 13/06* (2013.01); *B25B 23/0035* (2013.01)

(58) Field of Classification Search
USPC ..... 81/177.2, 177.1, 177.6, 177.7, 177.85
See application file for complete search history.

(56) References Cited

U.S. PATENT DOCUMENTS 1,651,361 A * 12/1927 Ayotte ..... B25B 23/0035 81/177.2
1,775,402 A * 9/1930 Mandl ..... B25B 13/56 81/177.75
2,896,489 A * 7/1959 Madsen ..... B25B 23/065 81/124.1
3,392,608 A * 7/1968 Schanen ..... B25B 17/02 81/57
4,991,470 A * 2/1991 Singleton ..... B25B 17/00 81/177.2
5,568,757 A * 10/1996 Lewis ..... B25B 15/001 81/177.2
5,943,925 A * 8/1999 Huang ..... B25G 1/007 81/177.1
6,089,133 A * 7/2000 Liao ..... B25B 15/02 81/177.2
6,662,688 B1 * 12/2003 Avery ..... B25B 13/005 7/100

(Continued)

*Primary Examiner* — Hadi Shakeri
(74) *Attorney, Agent, or Firm* — Dickinson Wright PLLC; Nicholas P. Coleman

(57) ABSTRACT

The housed socket extension has a high strength tubular housing with a socket extension apparatus which fits within the housing and protrudes from the ends of the housing. Two bearing retaining devices are mounted on the socket extension apparatus, adjacent to the ends of said housing. The first end of the socket extension receives a ratchet wrench or power tool, and the second end of the socket extension apparatus is designed to mate with a socket or tool bit.

8 Claims, 42 Drawing Sheets

(56) References Cited

U.S. PATENT DOCUMENTS

| | | | | |
|---|---|---|---|---|
| 7,926,388 | B2 * | 4/2011 | Lu | B25B 17/00<br>81/57.36 |
| 2007/0214916 | A1 * | 9/2007 | Lee | B25G 1/043<br>81/177.1 |

* cited by examiner

FIGURE 33
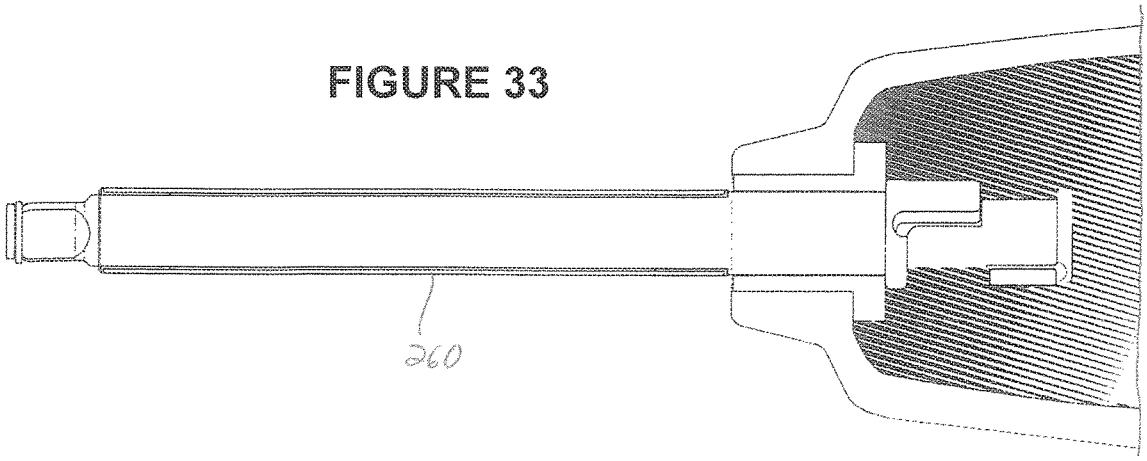
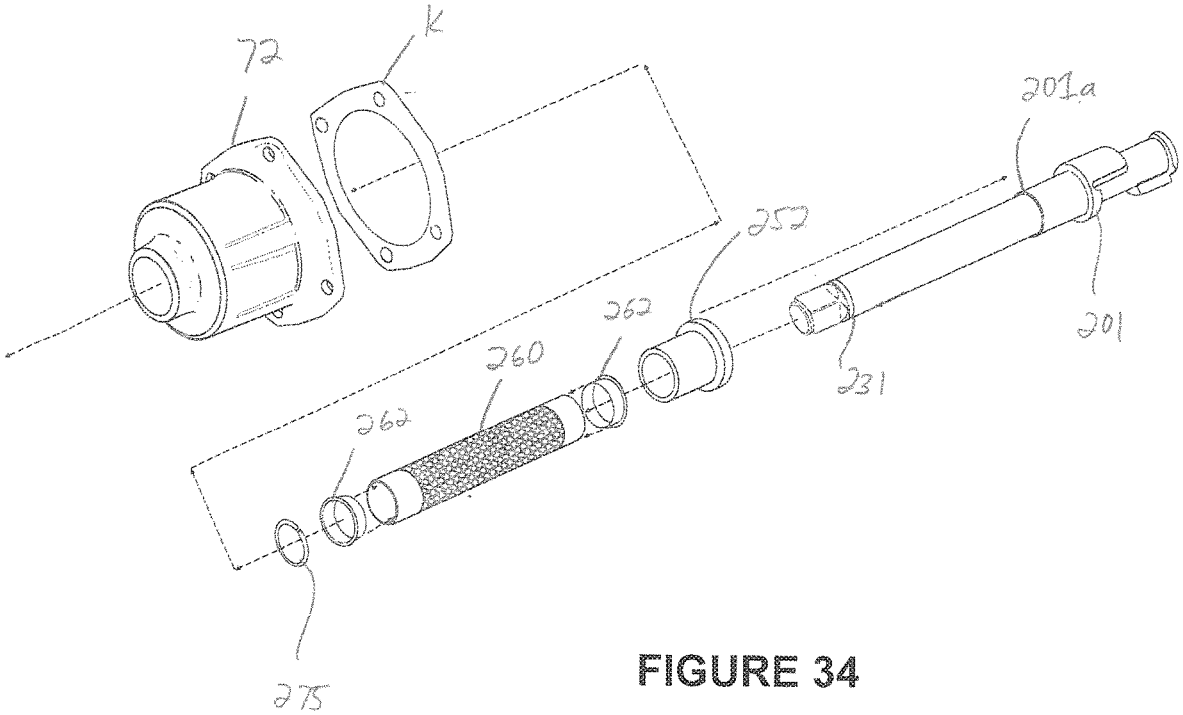
FIGURE 34

FIGURE 35
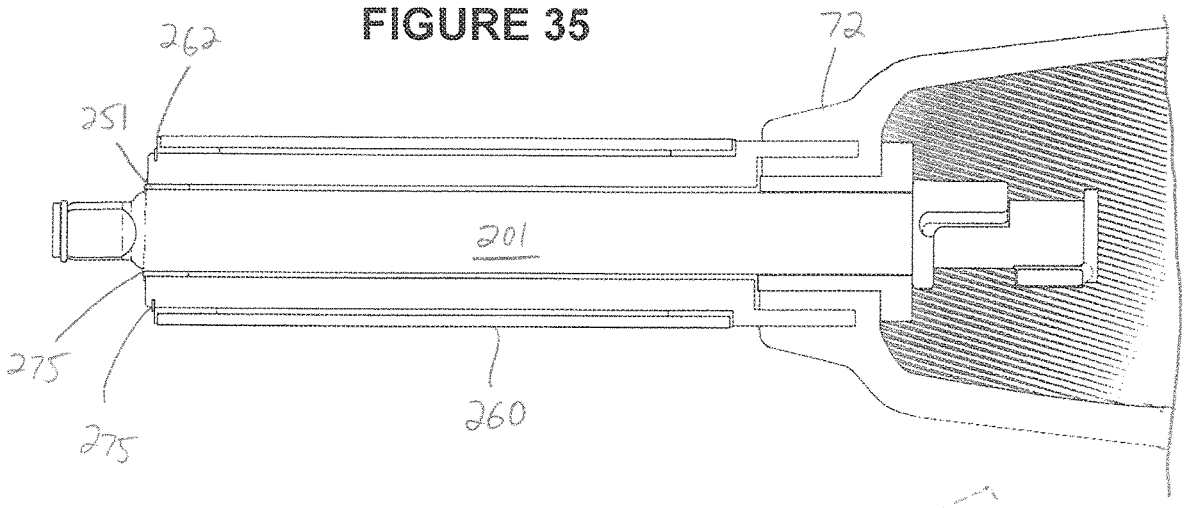
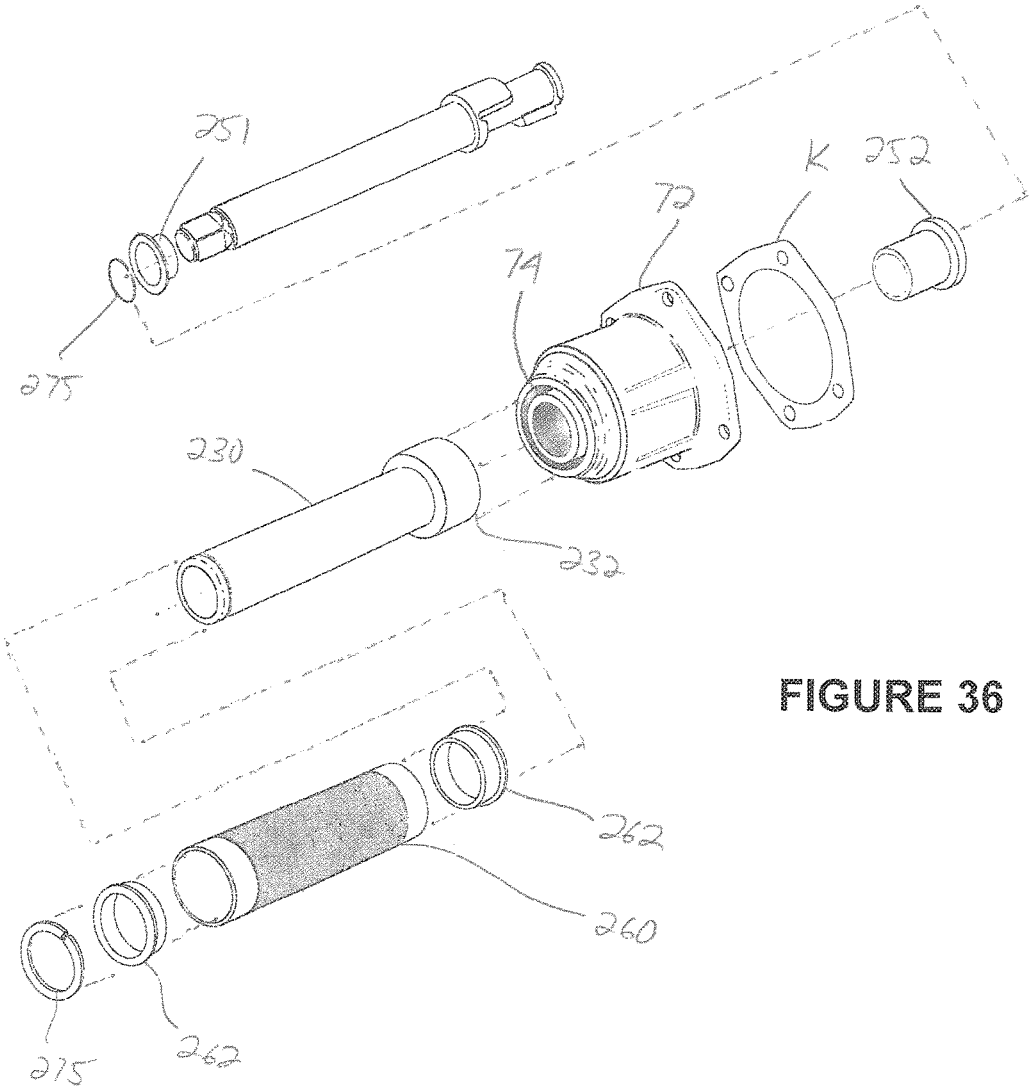
FIGURE 36

FIGURE 38
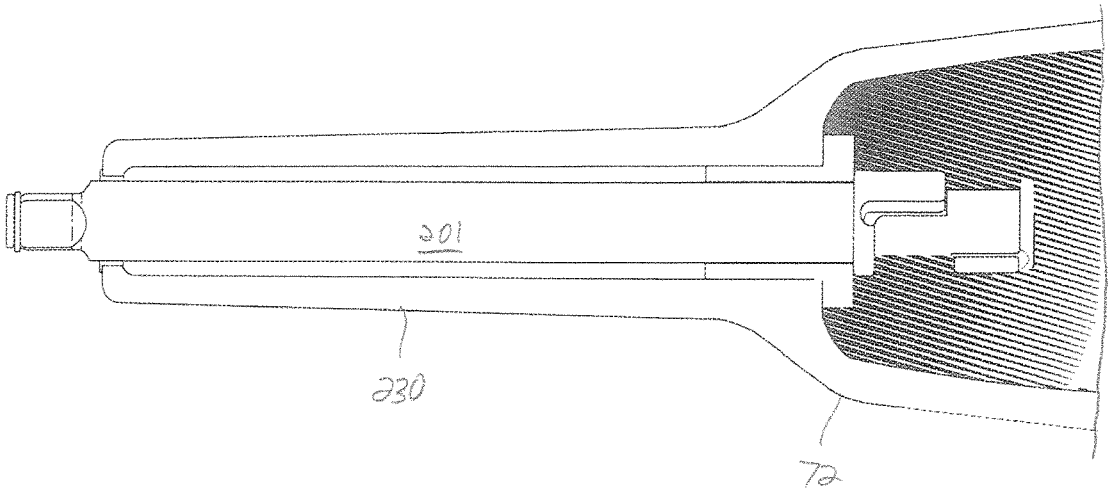
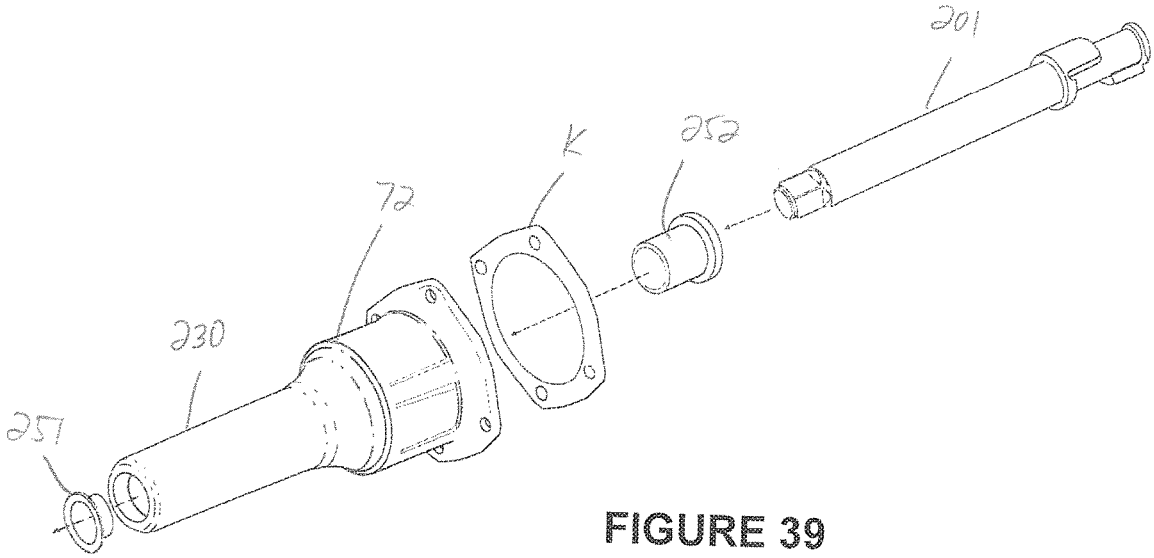
FIGURE 39

FIGURE 40
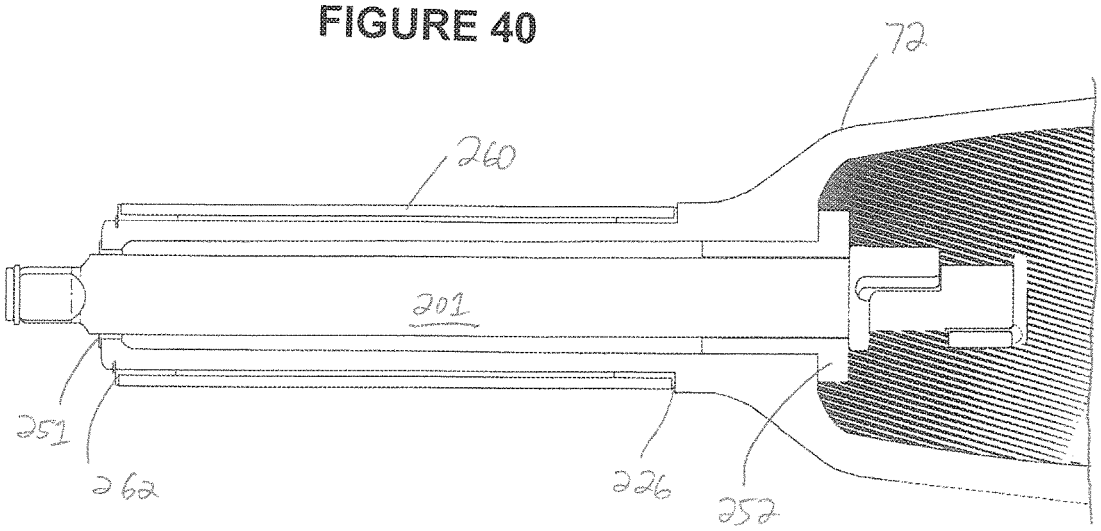
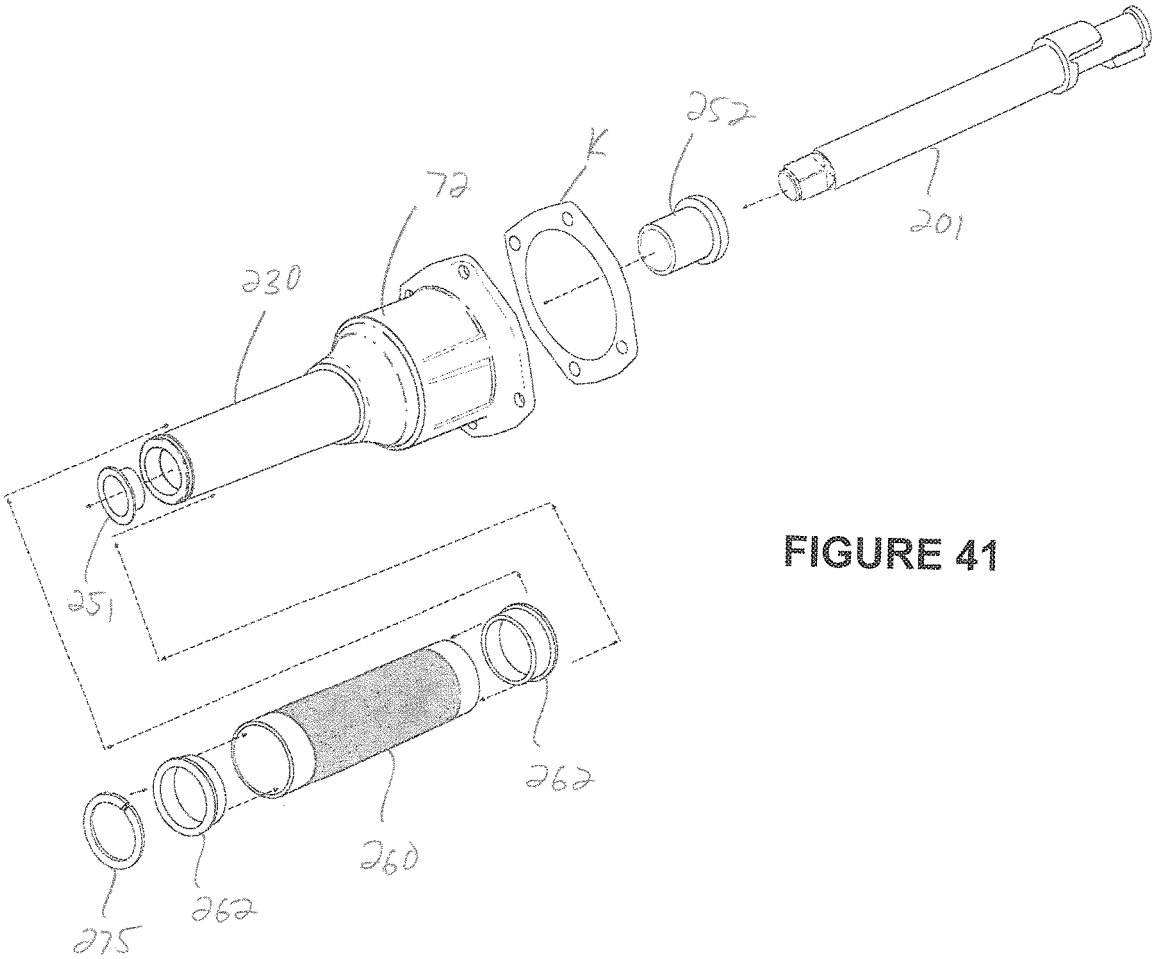
FIGURE 41

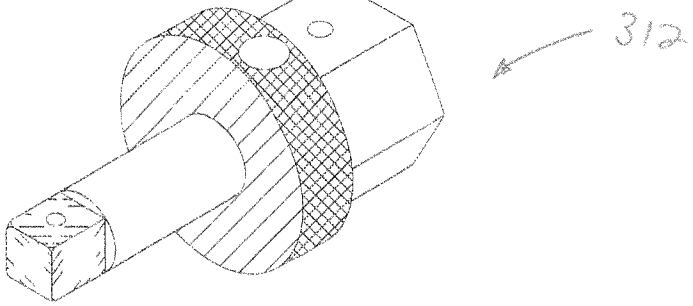
FIGURE 53
FIGURE 54
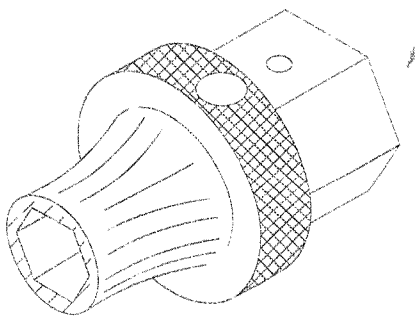
FIGURE 55
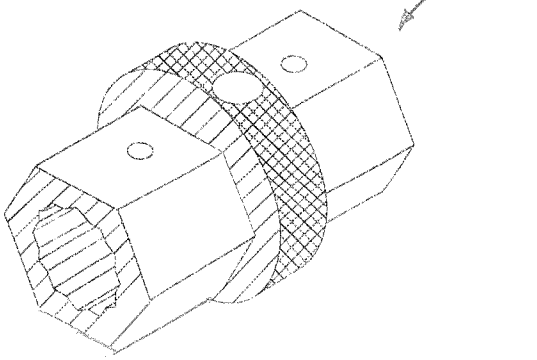
FIGURE 56

SOCKET APPARATUS

This application is a continuation of U.S. patent application Ser. No. 16/569,012, filed Sep. 12, 2019, which is a continuation of U.S. patent application Ser. No. 13/206,789, filed Aug. 10, 2011, which is a continuation-in-part of U.S. patent application Ser. No. 11/925,447, filed Oct. 26, 2007, which is a continuation-in-part of U.S. patent application Ser. No. 11/403,356, filed Apr. 13, 2006, the disclosures of which are incorporated herein by reference.

TECHNICAL FIELD AND INDUSTRIAL APPLICABILITY OF THE INVENTION

This disclosure relates to the tool arts and, more particularly, to an improved socket apparatus.

BACKGROUND OF THE INVENTION

The housed socket extension was designed to mitigate problems which arise in use with the conventional socket extension. Presently, a mechanic, technician or factory worker, while using a socket extension connected to a motorized power tool, must grasp the rotating socket extension with a bare hand to support the weight of the tools and direct the socket extension and socket to its point of use. This practice is troublesome, due to the extreme speeds that the socket extension may be rotating, which can be in excess of 15,000 RPMs (revolutions per minute). In addition, many times the socket extensions have metal debris, chips, slivers and other matter on their surface that could harm the hand during rotation of the socket extension. The high rate of speed can cause burns, abrasions, lacerations and other forms of damage to the hands, including repetitive strain injuries, such as Carpal Tunnel Syndrome.

SUMMARY OF THE INVENTION

An embodiment of the invention encloses a socket extension within a housing and permits rotation of the socket extension within the housing, without rotation of the housing itself.

The housing can be safely supported by the user's hand during high-speed axial rotation of the socket extension and thus eliminates the potential for the user to obtain dangerous burns, abrasions, lacerations and other forms of damage to the hands by isolating the contact of the user's hands from the high-speed rotating socket extension. In addition, the housed socket extension extends the drive shaft of the power tool used in conjunction with the tool. The housed socket extension absorbs vibrations for additional reduction in operator injury and fatigue. The housed socket extension helps reduce fatigue, stress, strains and motions that could lead to dangerous injuries.

An embodiment of the invention is a housed socket extension, which has a high strength tubular housing with a first and second end and an opening extending throughout the length of the housing from the first end to the second end. A socket extension apparatus having a first and second end, which are connected by a shaft, resides inside the opening of the tubular housing and extends throughout the opening with the first and second end of the socket extension apparatus extending beyond the ends of the housing. The tubular housing is rotatably mounted onto the socket extension apparatus. Located on each of the first and second ends of the tubular housing, a friction reducing device is mounted, such as a hushing, bearing or other similar device. This friction reducing device may be retained by a retaining device mounted on the shaft of the socket extension apparatus. Additional embodiments may only utilize one friction reducing device and retaining device.

Another embodiment of the invention uses the same structure but does not utilize 5 bearings within the ends of the tubular housing. In this embodiment, the tubular housing is constructed of a bushing material which allows the socket extension apparatus to rotate within the housing without the use of bearings.

The first end of the socket extension apparatus is designed so as to receive a ratchet wrench or power tool in a square hole located on its first end. The second end of the socket extension apparatus is square shaped so as to fit into the square hole of the socket or tool bit.

This embodiment of the invention allows a user to replace a conventional socket extension apparatus with one that is safe to hold and support with the bare hand. The housed socket extension is designed so that the outer surface of the tubular housing may be held safely with the user's bare hand while the socket extension apparatus is being rotated by any one of the several types of power driven tools, such as, but not limited to, a pneumatic impact wrench, electric impact wrench, pneumatic ratchet, electric or pneumatic drill, speed wrench and/or any other rotary device that could be used with a socket extension apparatus. This is achieved by the separation of the high-speed rotating socket extension apparatus via the rotating friction reducing devices and a non-rotating tubular housing or a non-rotating tubular housing comprised of a bushing material. It is further achieved by the optional additions of gripping textures, padding and/or the addition of an extended grip to the tubular housing.

Another use for this invention is with the use of a torque wrench device to calibrate the tightness of a nut or bolt. Typically, a hand is tightly holding the socket extension while applying a rotary force to the end of the torque wrench. The amount of force applied by the hand to the socket extension causes friction, therefore increasing the rotary drag to the wrench, which increases the torque measurement reading of the torque wrench. When using the housed socket extension in this application, the friction on the socket extension apparatus is reduced substantially, because of the friction reducing devices and/or bearing material and thus allows for a more accurate torque wrench reading.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the device and together with the description serve to explain certain principles of the invention. In the drawings:

FIGS. 28-44 illustrate various alternate embodiments of the socket apparatus.

FIGS. 45-60 illustrate various embodiments of socket adapters.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
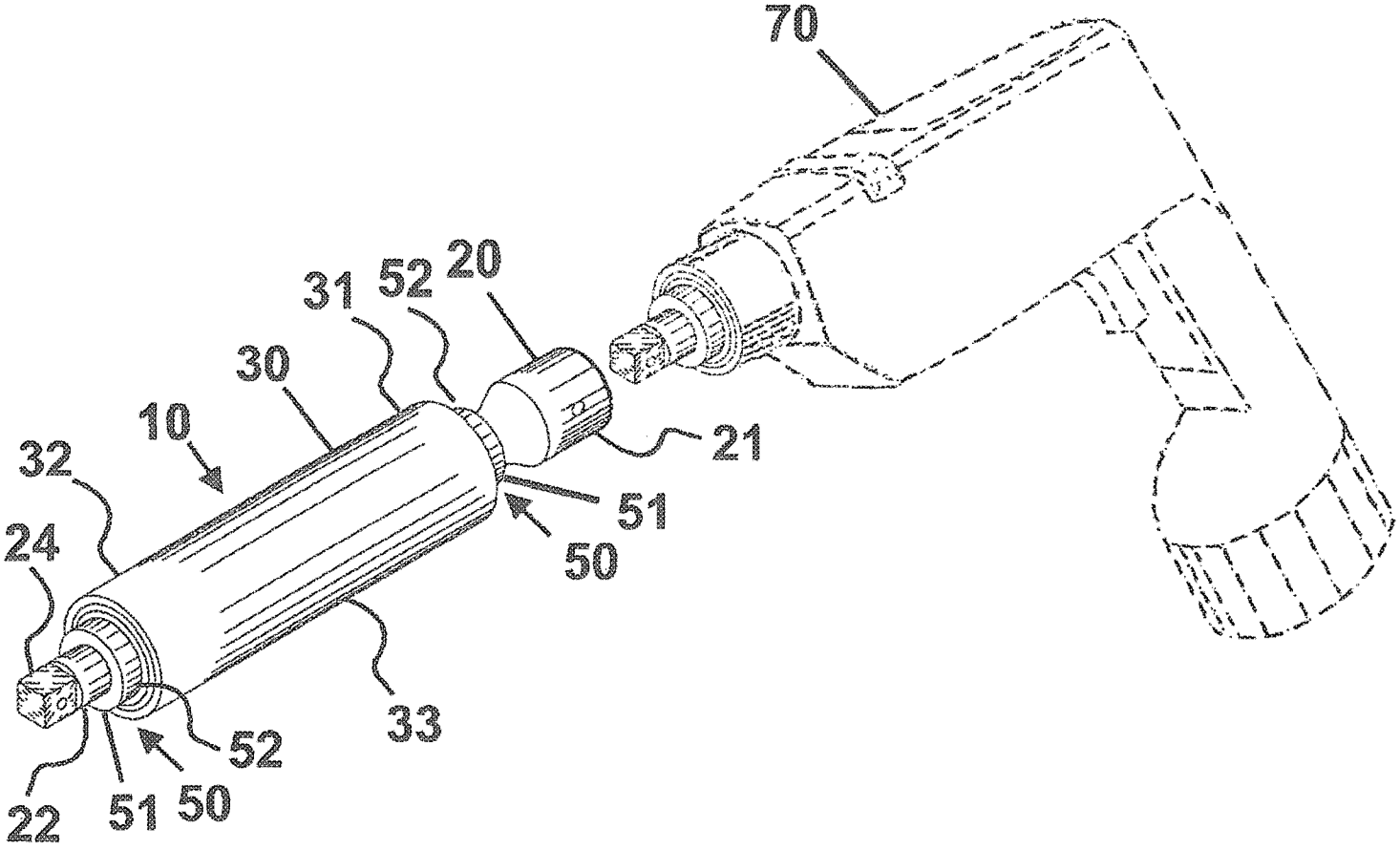
FIG. 1 shows an isometric view of the device.
Figure 2:
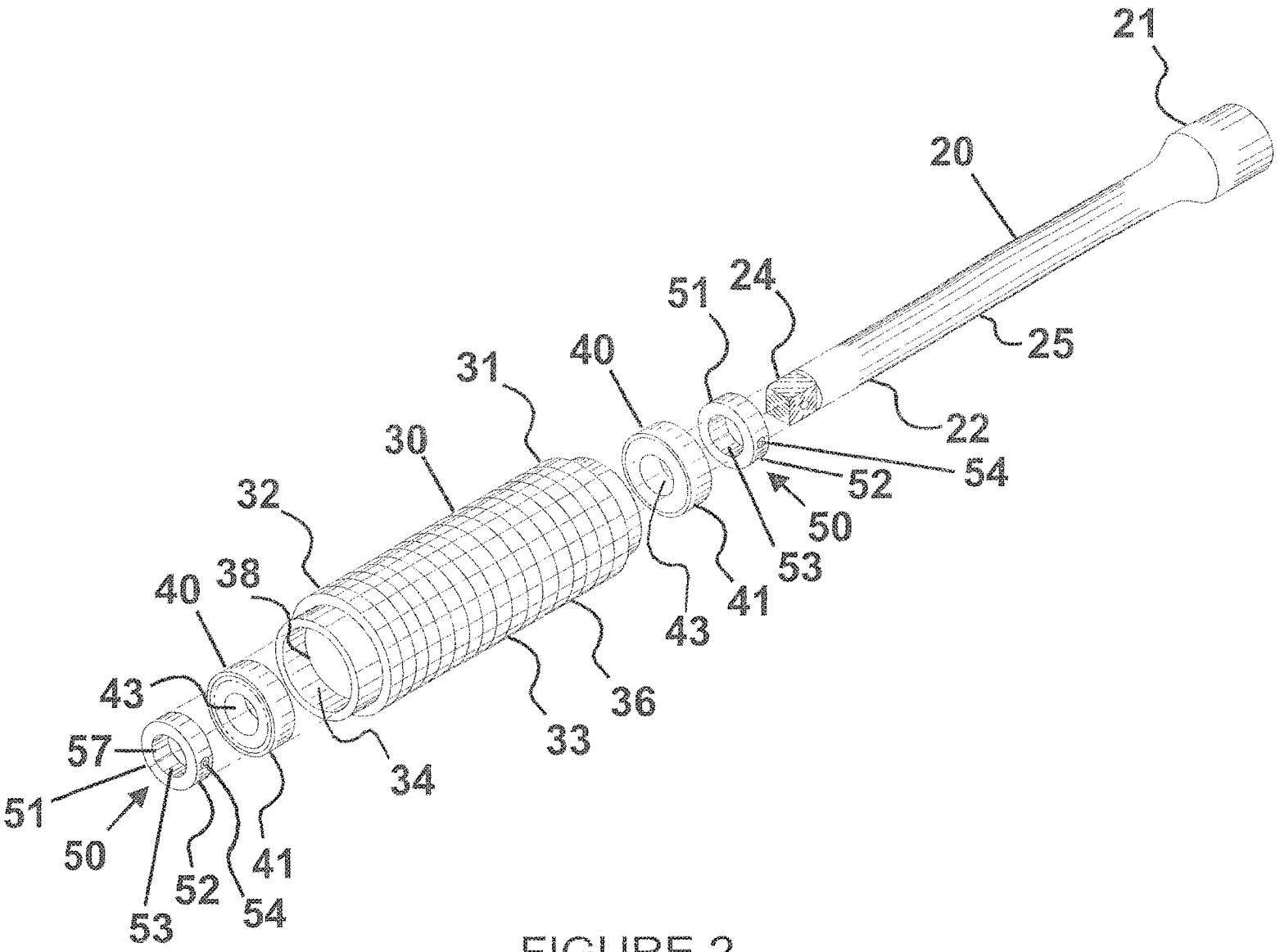
FIG. 2 shows an exploded isometric view of the device.

FIGS. 1 and 2 show a housed socket extension 10 which has a high strength tubular housing 30 with a first and second end 31, 32 and an opening 38 in the first end 31 that extends through the full length of the said housing 30 in the direction of the axis to the second end 32. The housing 30 has an outer surface 33 and an inner surface 34. The tubular housing 30 can be made of metal and/or high strength plastic so as to be suitable for heavy duty, high-speed rotation along with high torque while retaining a socket extension apparatus 20.

Figure 3:
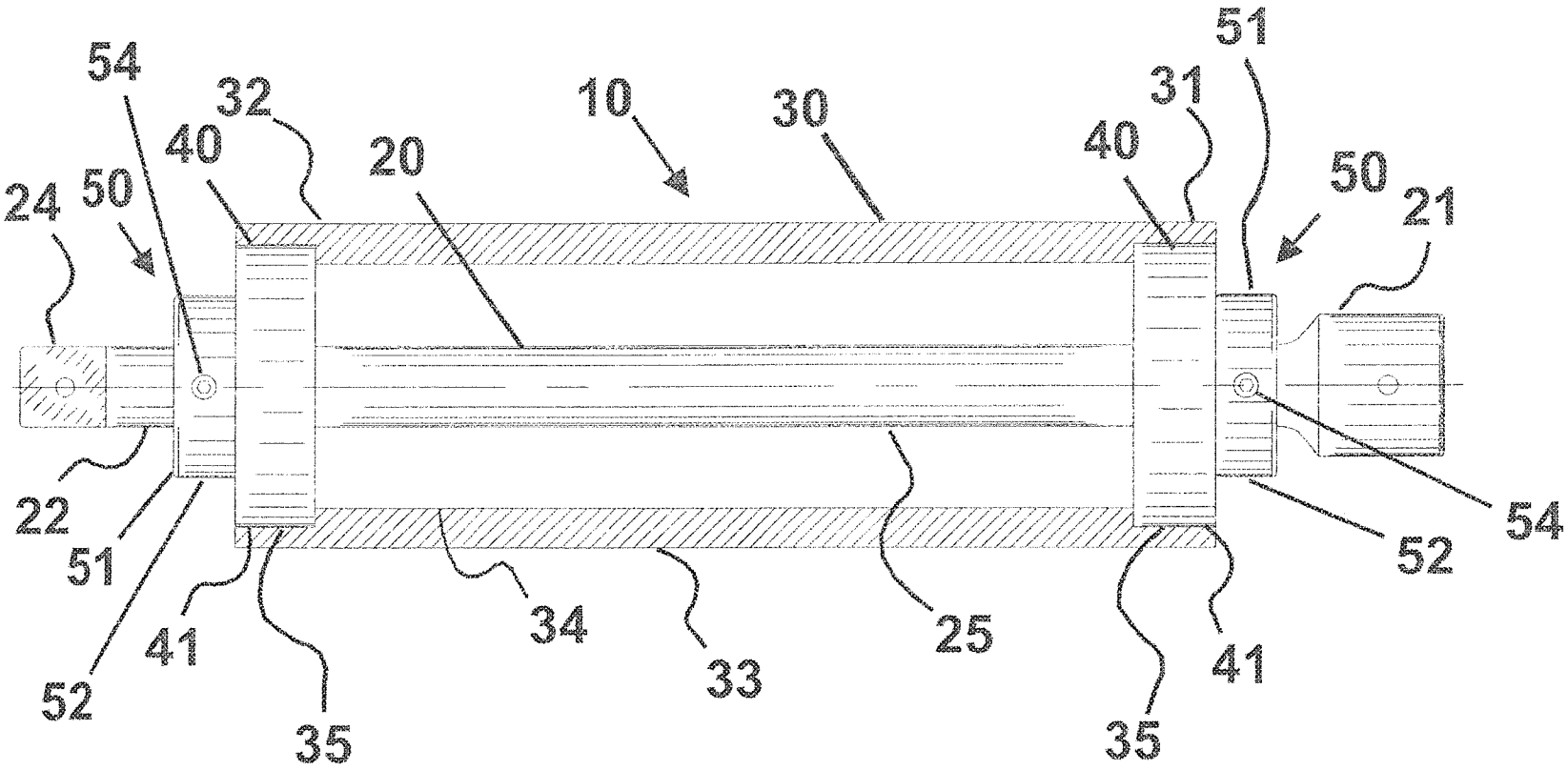
FIG. 3 shows a cut-away side view of the device.

As can be seen in FIG. 3, the first and second ends 31, 32 of the housing 30 may have a counter bore 35 on the inner surface 34, which extends into the housing 30 at a width and depth sufficient to accept friction reducing means such as bushings or bearings 40 or other similar device. These bushings or bearings 40 are inserted into the counter bores 35 of the housing 30. In FIG. 3, the counter bores 35 are sized to properly retain the outer surface 41 of the bearings 40 which retains the bearings 40 in place. The bearings 40 prevent the housing 30 from rotating during full load and high-speed rotation of the socket extension apparatus 20.

The overall length of the housing 30 will vary according to the application requirement but, typically, it will be long enough so that a human hand or hands may grasp it securely and yet avoid contact of the hand to the rotating socket extension apparatus 20. By utilizing the device, the rotating drive of the power tool 70 is extended, making it available for a larger variety of purposes. Shorter housings 30 may be used in applications where only finger or partial hand contact support is necessary.

Figure 9:
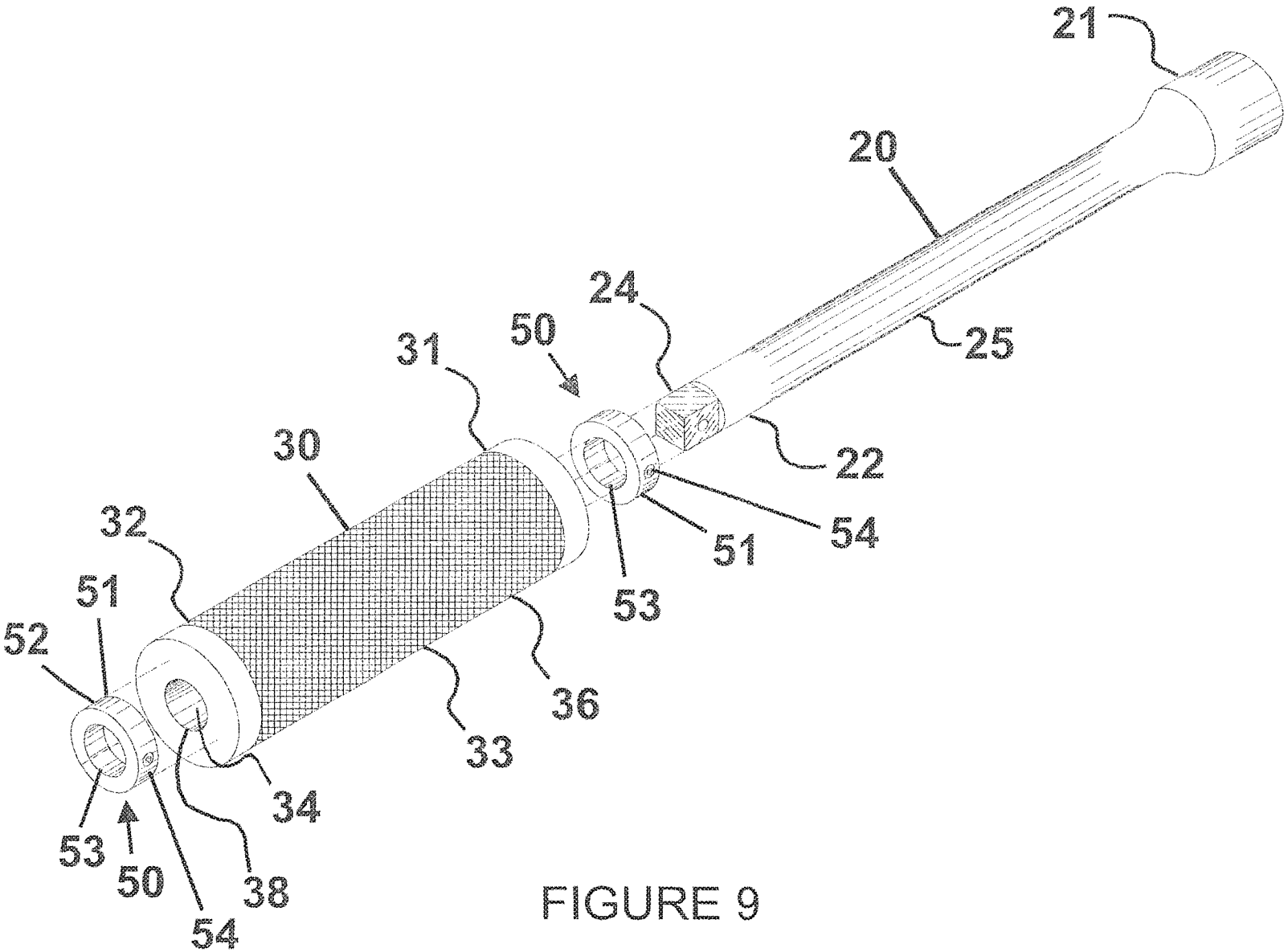
FIG. 9 shows an exploded isometric view of an alternative embodiment of the device.

The outer surface 33 of the tubular housing 30 may have different gripping material 36, as is shown in FIGS. 2 and 9. This gripping material 36 can be, but is not limited to, knurling, waffling, etching, ribs, grids, etc. The outer surface 33 of the tubular housing 30 may be padded with a gripping material 36, such as rubber, plastic, cloth or any other material that would improve the grip for safety, comfort or personal preference of the operator. The thickness of the gripping material 36 may vary dependent on the operator and the applications where the housed socket extension 10 is used. The gripping material 36 may be permanent, replaceable or removable.

Figure 8:
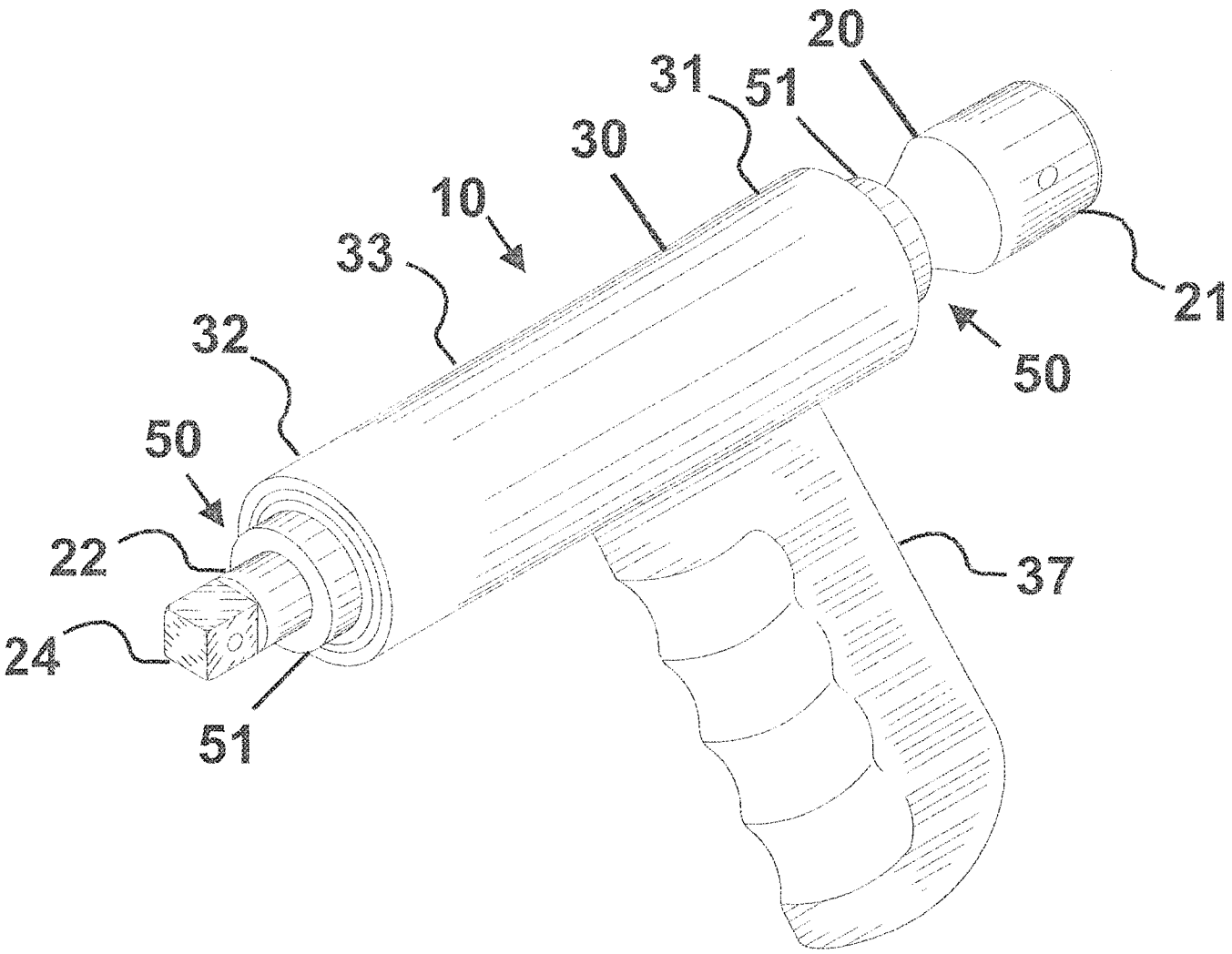
FIG. 8 shows the device with an extended grip.

The tubular housing 30 may be combined with an extended grip 37, as is shown in FIG. 8, such as a vertical or diagonal extension which would protrude away from the horizontal axis of the tubular housing 30 in the similar way that a conventional pistol grip would. The angle and length of this extended grip 37 may vary to suit the operator and/or applications. The extended grip 37 may be made of metal and/or high strength plastic so as to be suitable to withstand any heavy duty, high-speed rotation and high torque while retaining the socket extension apparatus 20. The extended grip 37 surfaces may be, but are not limited to, knurling, waffling, etching, ribs and/or padded with rubber, plastic, cloth or any other material that would improve the grip for safety, comfort or personal preference of the operator. The extended grip 37 and/or the gripping material 36 may be permanent, replaceable or removable.

A socket extension apparatus 20 with shaft 25 connecting a first and second end 21, 22 resides within the opening 38 of the housing 30. The housing 30 surrounds the shaft 25 of the device. The first and second ends 21, 22 of the socket extension apparatus 20 extend beyond each of the first and second ends 31, 32 of the housing 30.

The device may utilize a friction reducing device, such as bearings, bushings or other similar devices. If bearings 40 are utilized in the device 10, the bearings may be metal ball, roller, needle and/or solid bearing material of metal or synthetic type, providing they meet or exceed the maximum rotary and linear load requirements at the maximum speed of the socket extension apparatus 20 and the power source to be used. The bearings 40 may be sealed or shielded to prevent contamination and improve the life of the device 10. The bearing 40 material may be an integral part of the housing 30 or socket extension apparatus 20, providing that the material meets or exceeds the maximum axial rotary and linear load requirements at the maximum speed of the socket extension apparatus 20 and the power source to be used.

In an embodiment of the invention, the bearing retaining devices 50 are placed on the shaft 25 of the socket extension apparatus 20 and adjacent to each of the first and second ends 31, 32 of the housing 30. Several common types of bearing retaining devices 50 may be utilized in the device 10. One such bearing retaining device 50, as shown in FIGS. 2 and 3, consists of a round collar ring 51. The collar ring has an inner surface 53 and outer surface 52 with an opening 57 extending through its longitudinal axis. The collar ring 51 has a setscrew 54 that protrudes through the outer surface 52 of the collar ring 51 and extends through the inner surface 53. The setscrew 54, or multiple screws, make pressure contact to the socket extension apparatus 20 near each of its ends 21, 22, The setscrew 54 pressure affixes the bearing retaining device 50 to the socket extension apparatus 20 and assists in preventing the bearings 40 from moving in an axial direction away from the housing 30 but still allows the socket extension apparatus 20 to rotate freely.

Figures 4, 5, 6:
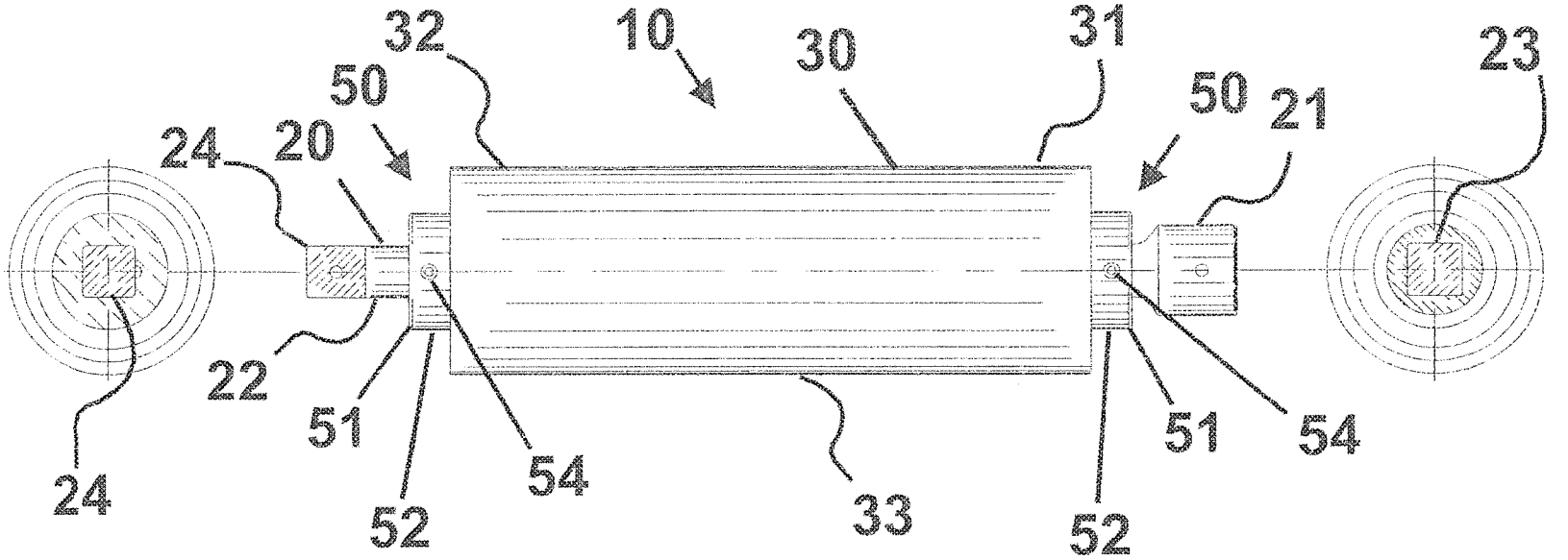
FIG. 4 shows a side view of the device.
FIG. 5 shows a front view of the device.
FIG. 6 shows an end view of the device.

The socket extension apparatus 20 has a second end 22 which is square-shaped with a male end 24 that can be coupled with a socket or a tool bit, as shown in FIG. 5. The first end 21 of the socket extension apparatus 20 is formed with an enlarged head, which defines a square recess 23 therein for receiving a square head of a socket wrench or power tool 70, as shown in FIG. 6. The male end 24 includes a ball provided thereon so the socket can be tightly mounted on the male end 24 of the socket extension apparatus 20.

Figure 7:
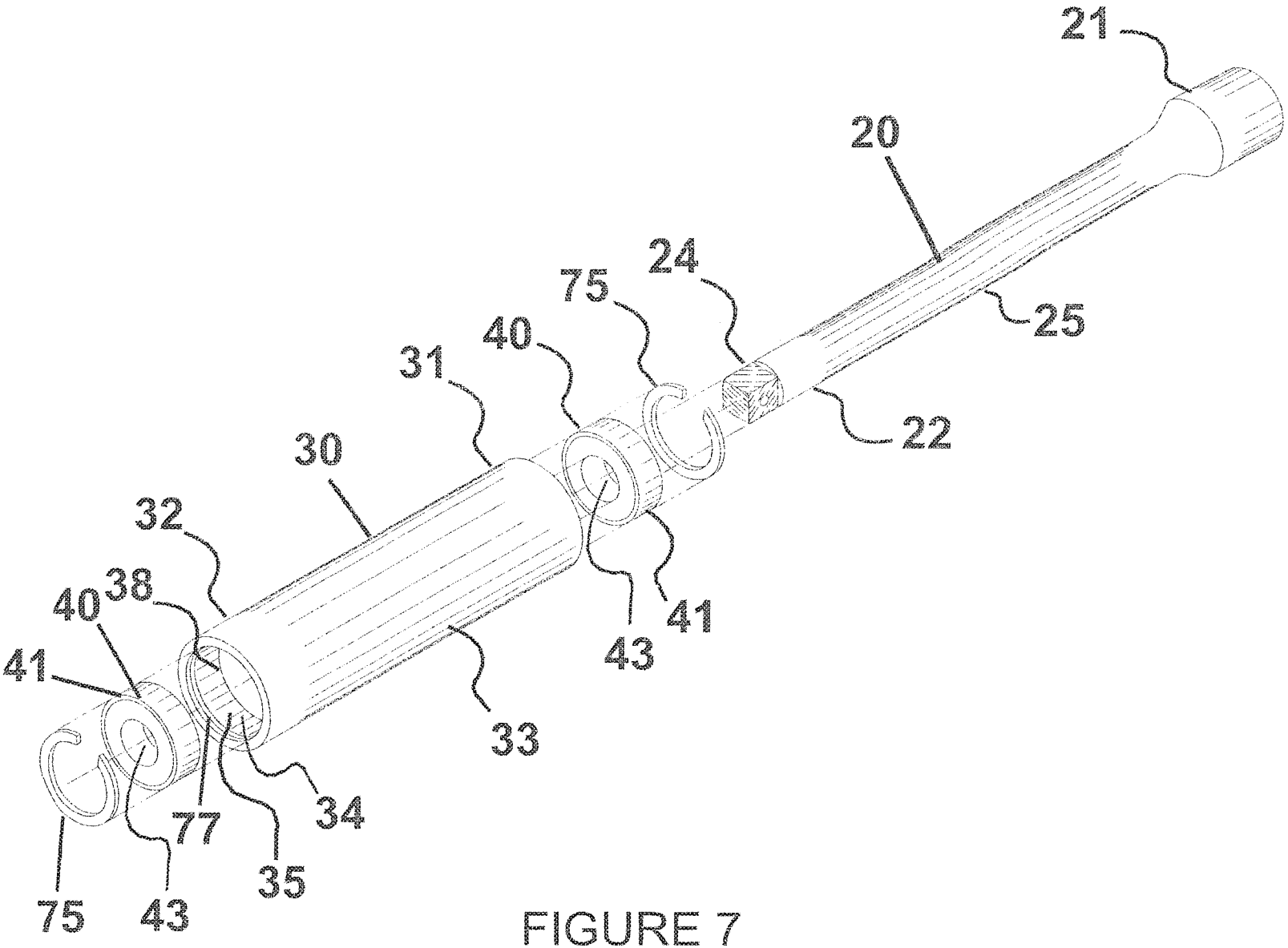
FIG. 7 shows an exploded isometric of the device.

Another bearing retaining device 50 is a snap ring 75, as shown in FIG. 7, and is used to restrain the friction reducing devices, such as bushings or bearings 40 from moving outward from the housing 30. The snap ring 75 is a thin round device made of a spring-type metal. The outer circumference of the snap ring 75 can be squeezed to a smaller pre-determined diameter and has the ability to expand back to its original size when the pressure is released. If snap rings 75 are utilized in the device 10, each of the first and second ends 31, 32 of the tubular housing 30 has a shallow groove 77 of a size and depth that will receive the snap ring '75 and retain it when it is in its expanded condition. In this embodiment, the bearings 40 will be pressed onto both ends of the socket extension apparatus 20 using an interference fit, which means the opening 43 of the bearing 40 is slightly smaller than the shaft 25 of the socket extension apparatus 20. The bearing 40 on the first end 21 of the socket extension apparatus 20 is installed before the socket extension apparatus 20 is inserted into the housing 30. The socket extension apparatus 20 with the first bearing 40 installed is then inserted into the tubular housing 30, whereas the second bearing 40 is then installed on the second end 22 of the socket extension apparatus 20. After the bearings 40 and socket extension apparatus 20 are installed into the tubular housing 30, one or more snap rings 75 are installed on each of the first and second ends 31, 32 of the housing 30. FIG. 7A shows a similar embodiment as is shown in FIG. 7, except that the friction reducing means are bushings instead of bearings.

Figure 10:
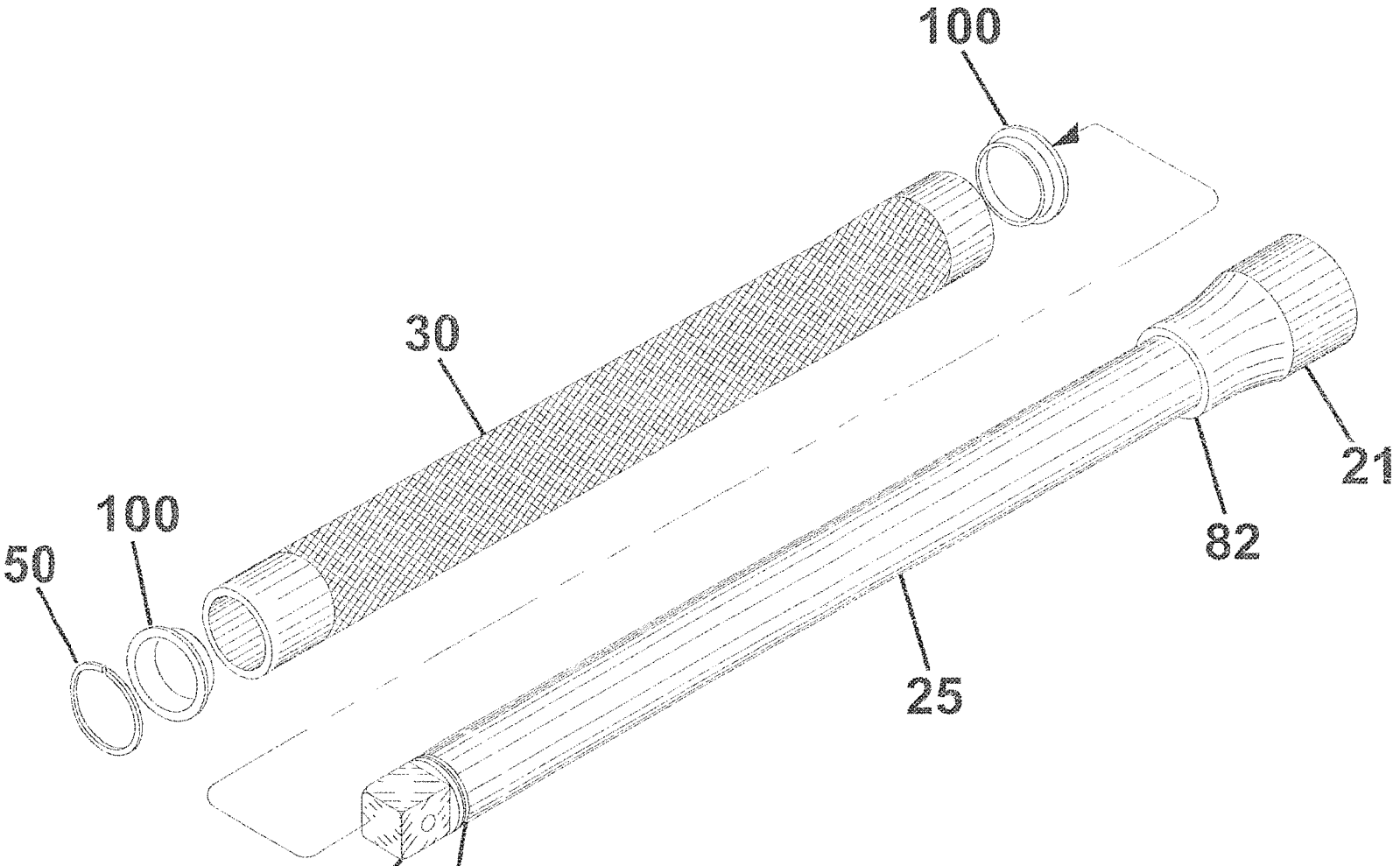
FIG. 10 shows an exploded isometric, view of an alternative embodiment of the device.

FIG. 10 illustrates an embodiment wherein only one bearing retaining device 50 is utilized in this embodiment, the shaft 25 of the socket extension apparatus 20 is cut into a smaller diameter forming a step 82 toward the first end 21 of the socket extension apparatus 20. The tubular housing 30 surrounds the shaft 25 and is rotatably mounted onto the shaft 25 of the extension apparatus 20. The step 82 toward the first end 21 of the socket extension apparatus 20, assists in retaining the housing 30 and any friction reducing device onto the extension apparatus 20. Friction reducing devices 100, such as bushings, bearings or other similar devices, may be used on each end 31, 32 of the tubular housing 30. A retaining device 50 such as a snap ring 75 may be used on the second end 32 of the tubular housing 30 to assist in maintaining the housing 30 onto the shaft 25 of the extension apparatus 20. This embodiment of the invention allows for a smooth finish and appearance of the device by making the housing 30 flush with the socket extension apparatus 20.

Figure 10A:
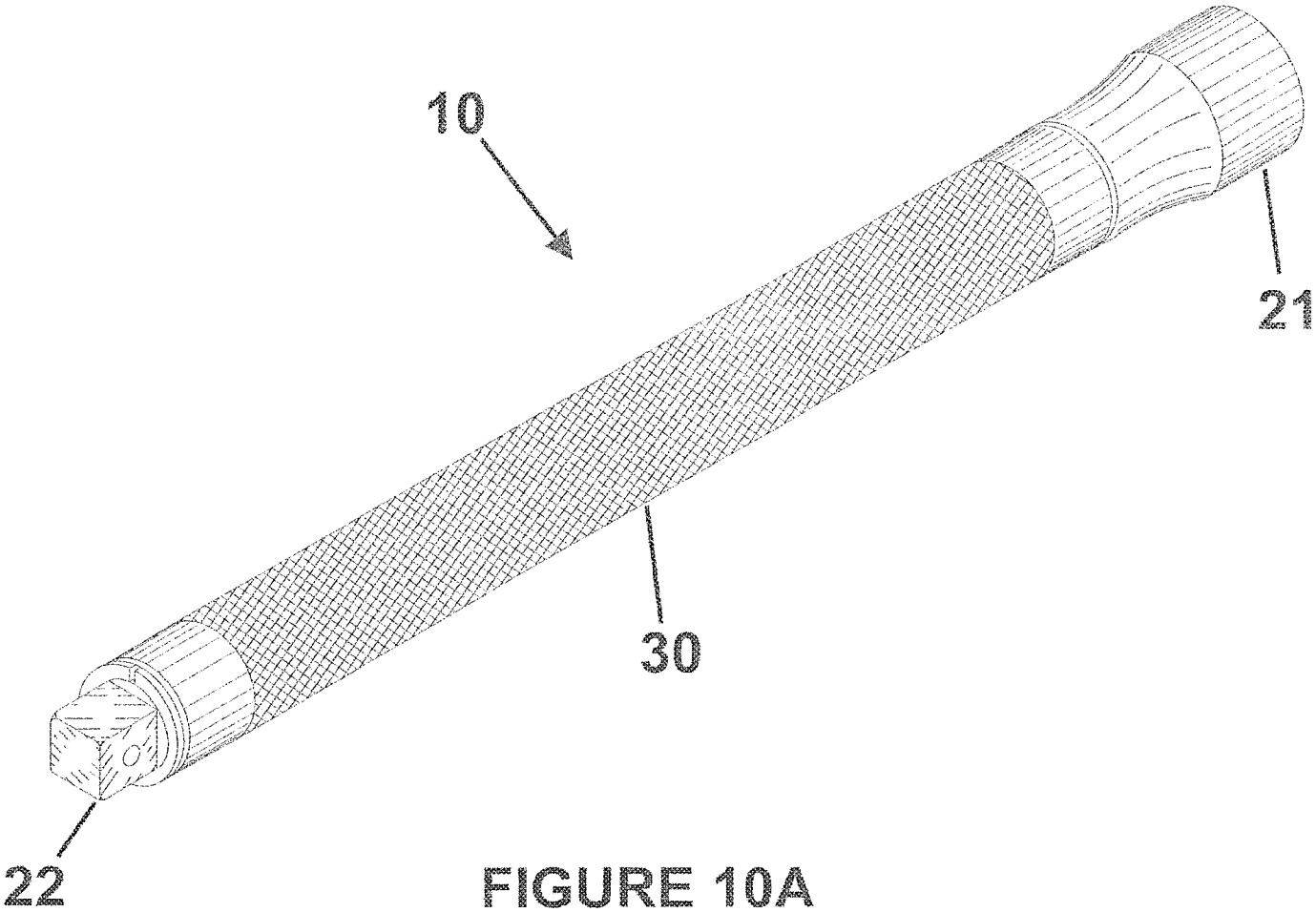
FIG. 10A shows a perspective view of an alternative embodiment of the device.

FIG. 10A discloses an alternative embodiment of the device wherein the recess 82 is formed on the shaft 25 of the socket extension apparatus 20 as is shown in FIG. 10, but the friction reducing devices 100 are not used on the first and second ends 31, 32 of the tubular housing 30. In FIG. 10A, the inner surface 34 of the tubular housing 30 is manufactured of a bushing material suitable for reducing friction between said housing 30 and the shaft 25 of the socket extension apparatus 20 and therefore allows free rotation of said socket extension apparatus 20 yet maintaining isolation between the high-speed rotating socket extension apparatus 20 and the human hand. A bearing retaining device, 50 such as a snap ring 75 may be utilized on the second end 32 of the tubular housing 30 to retain the housing 30 onto the socket extension apparatus 20. The snap ring 75 is retained by a groove 78 located toward the second end 24 of the socket extension apparatus 20.

Another embodiment of the invention is shown in FIG. 9 and consists of a tubular housing 30, a socket extension apparatus 20 and two bearing retaining devices 50. In this embodiment, the inner surface of the tubular housing 30 is manufactured of a bearing or bushing material suitable for reducing friction between said housing 30 and the socket extension apparatus 20, therefore allowing free rotation of said socket extension apparatus 20 yet maintaining isolation between the high-speed rotating socket extension apparatus 20 and the human hand.

The opening 38 in the housing 30 is slightly larger in diameter than the shaft 25 of the socket extension apparatus 20. The socket extension apparatus 20 resides inside the opening 38 of the tubular housing 30, with the first and second ends 21, 22 of the socket extension apparatus 20 extending beyond the ends 31, 32 of the tubular housing 30.

The inner surface 34 of the tubular housing 30 may be comprised of a bushing material such as, but not limited to, brass, bronze, polyamide, fluoropolymer, nylon, carbon fiber, polyimide or polyester and/or any other materials that would withstand the rotary loads and high speeds applied during use. Conversely, the shaft 25 of the socket extension apparatus 20 could be coated or layered with any of the said materials that would be compatible to the said materials of the tubular housing 30. Typically, the socket extension apparatus 20 is coated with a smooth hard chrome and therefore could be used with the tubular housing 30 made of a softer material compatible with said chrome.

A retainer 50 placed at each end of the housing 30 prevents it from moving outward on the socket extension apparatus 20. Several common types of retainers 50 may be utilized, including for example a round collar ring 51 that has an opening 57 extending through the axis. The collar ring 51 may include a setscrew 54 that protrudes through the outer surface 52 of the collar ring 51 and extends to the inner surface 53 of the collar ring 51. The setscrew 54 or multiple screws make pressure contact to the shaft 25 of the socket extension apparatus 20. The setscrew 54 pressure affixes the collar ring 51 to the socket extension apparatus 20 and restrains the tubular housing 30 from moving in an axial direction but still allows the socket extension apparatus 20 to rotate freely.

Figure 11:
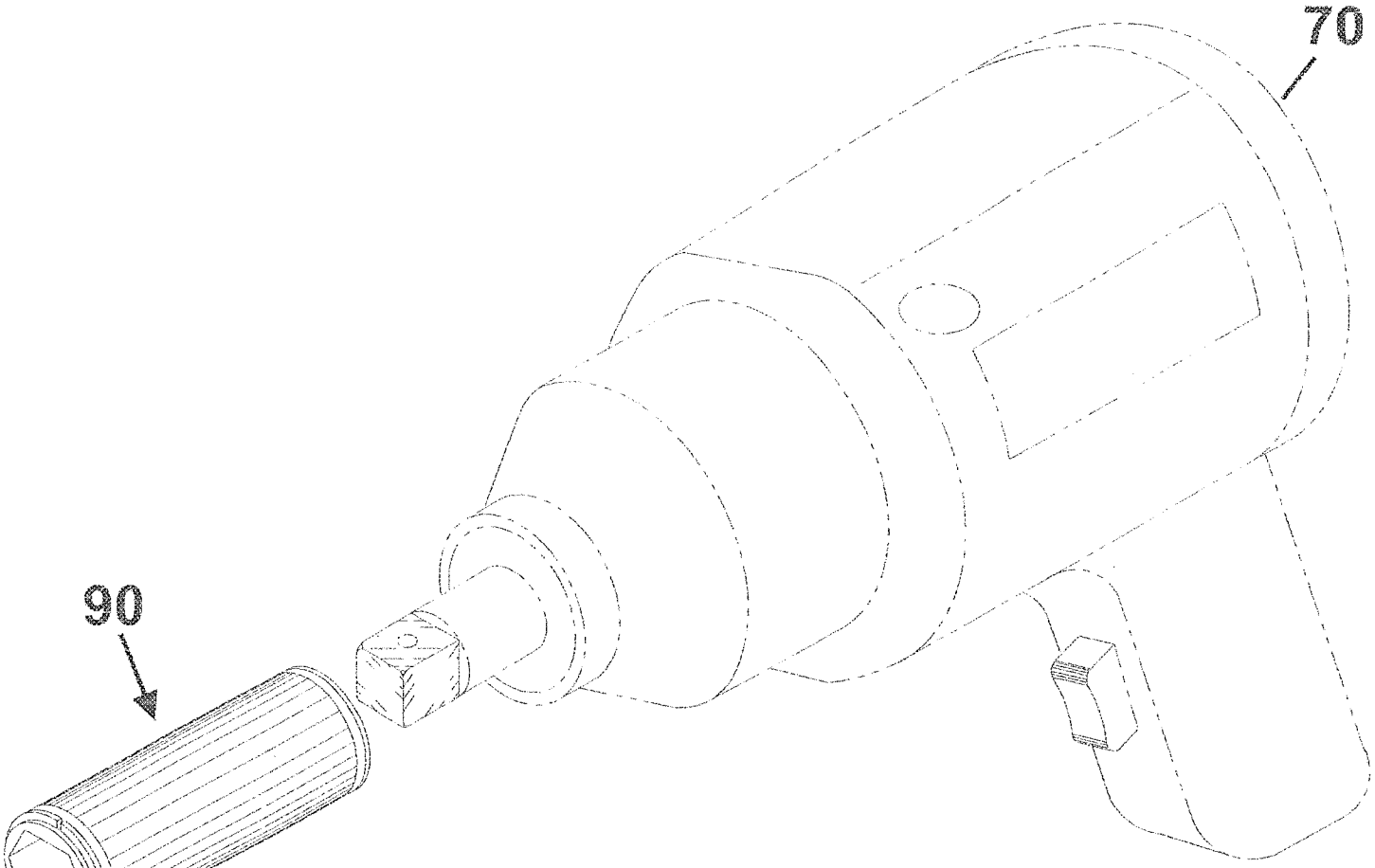
FIG. 11 shows view of an alternative embodiment of the device connected to a rotary power tool.
Figure 12:
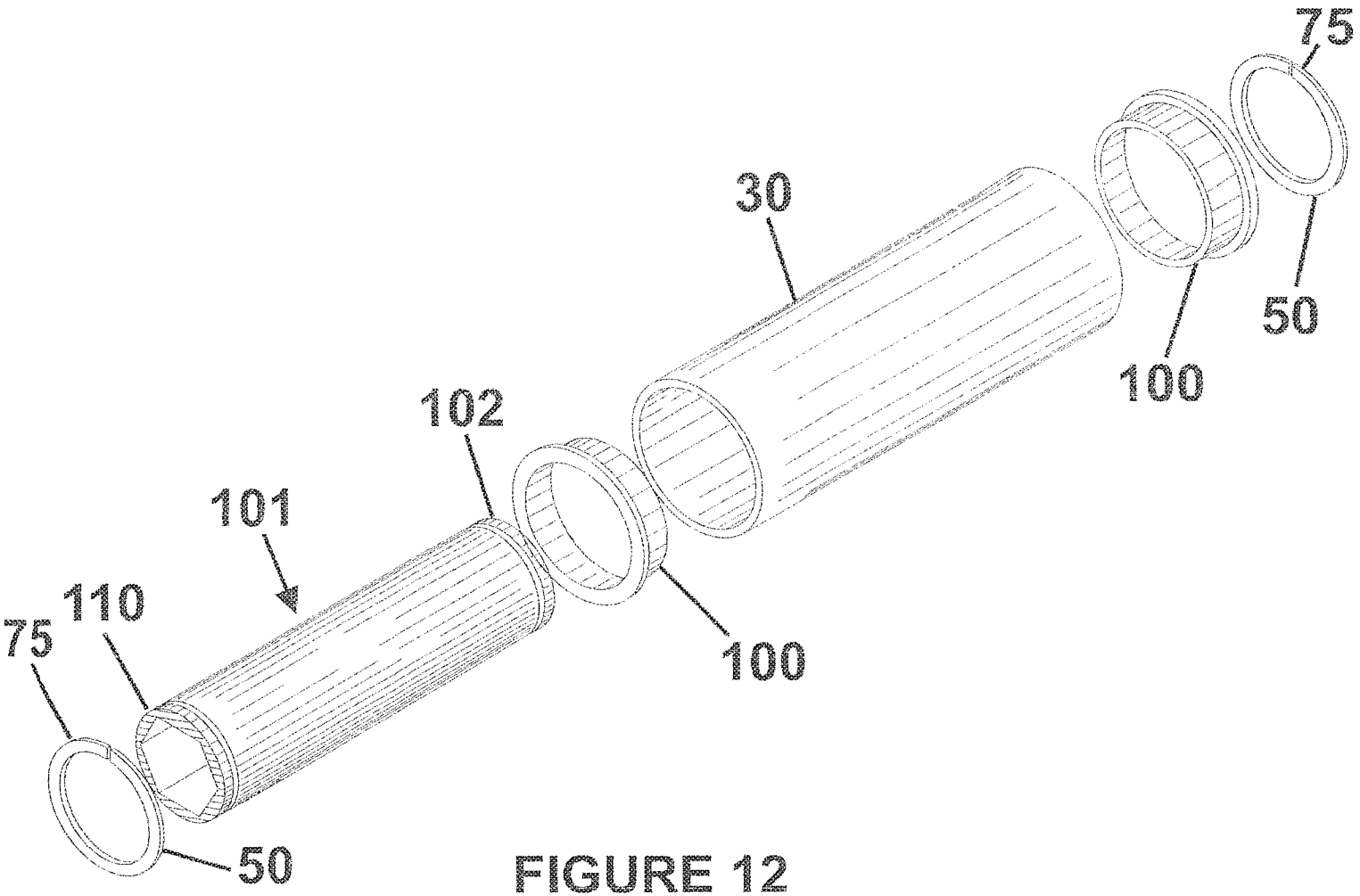
FIG. 12 shows an exploded isometric view of an alternative embodiment of the device.
Figure 17:
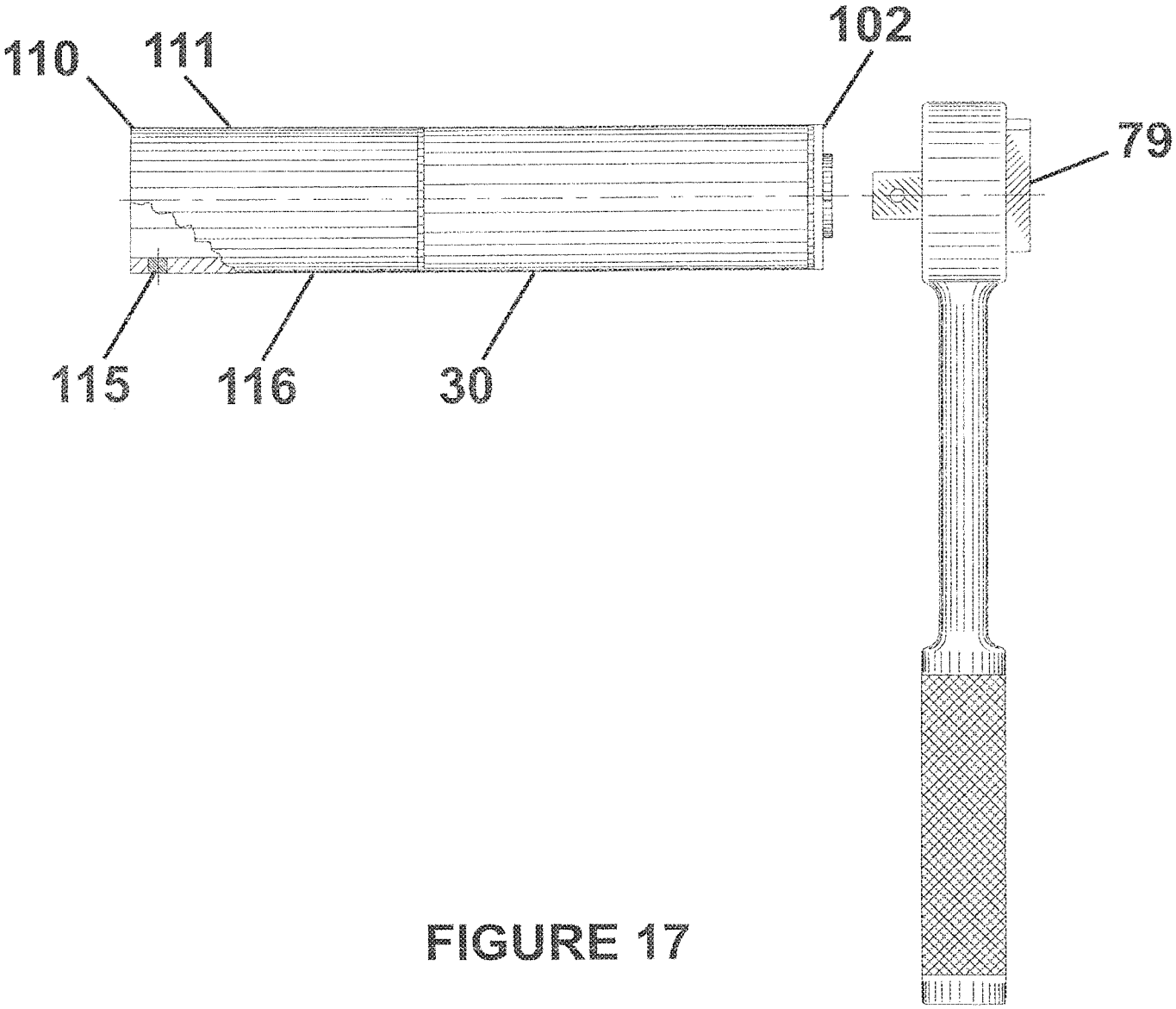
FIG. 17 shows a side view of the alternative embodiment of the present invention shown in FIG. 16 in use with a ratchet.

FIGS. 11 and 12 disclose an alternative embodiment of the device, a housed extension bar 90. In FIG. 11, an alternative embodiment is shown connected to a motorized power source 70, which effectively extends the rotary drive of the power tool. The device may also be used in conjunction with a hand ratchet as is shown in FIG. 17.

Figure 13:
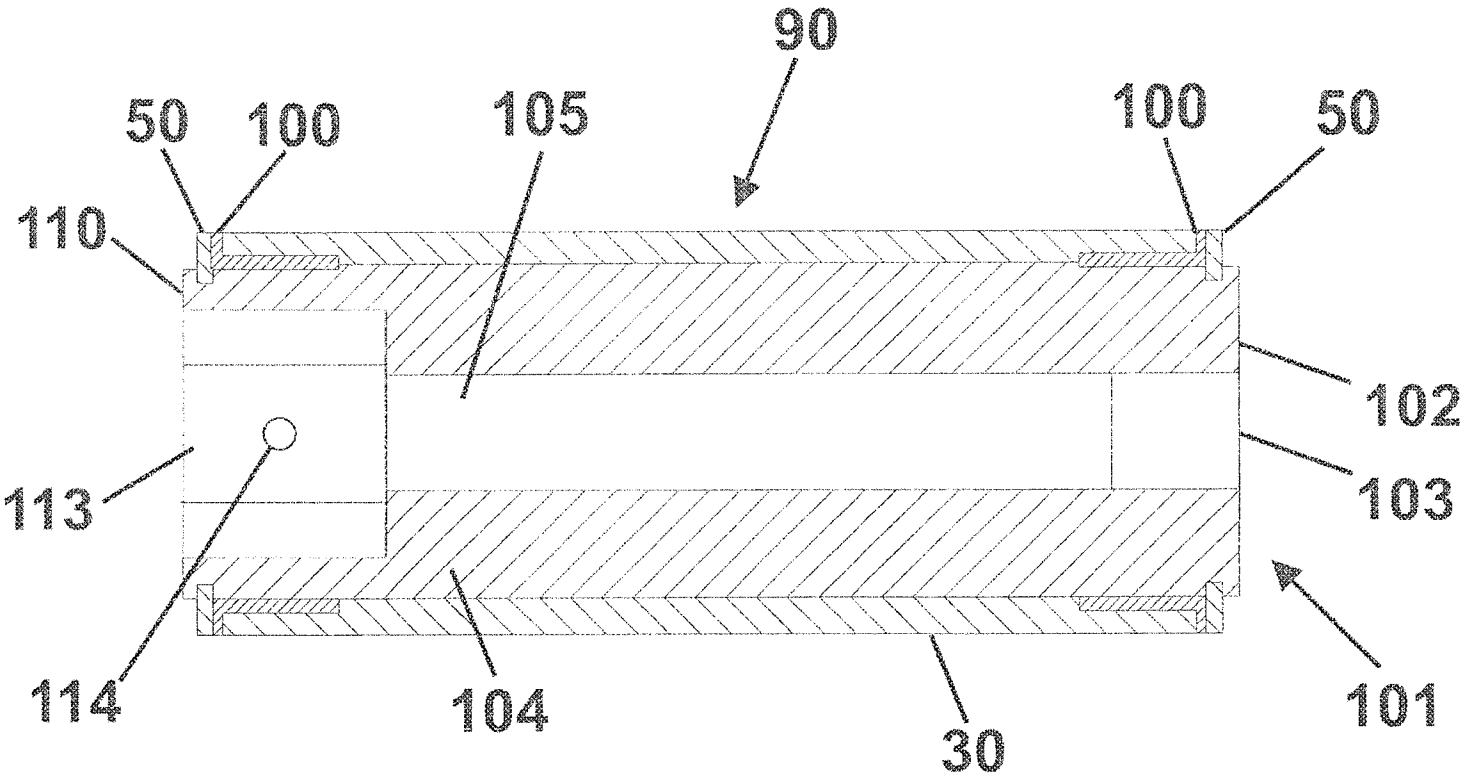
FIG. 13 shows side cut-away view of the alternative embodiment of the device shown in FIG. 12.
Figure 13B:
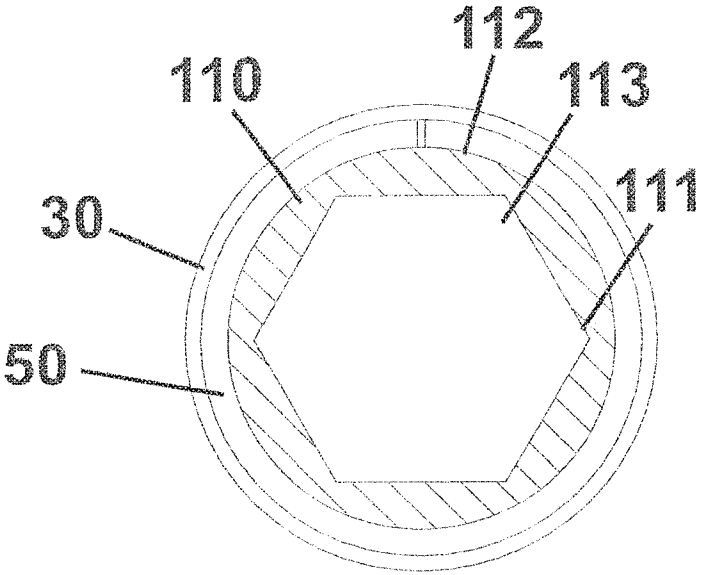
FIG. 13B shows end view of second end of the alternative embodiment of the device shown in FIG. 12.
Figure 13A:
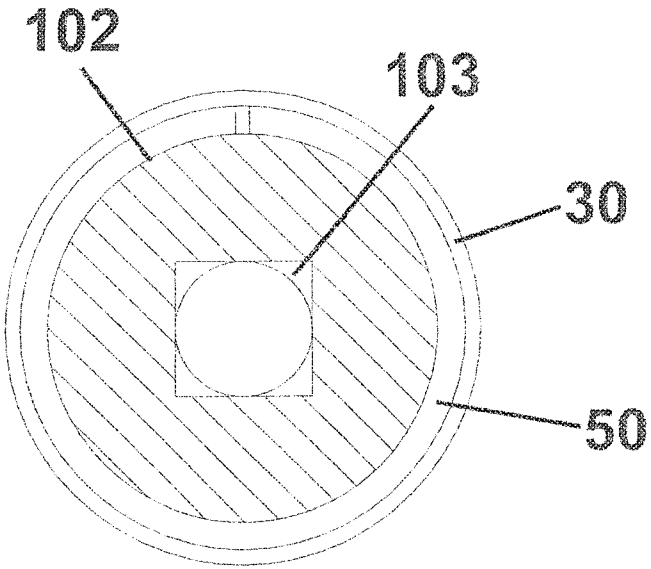
FIG. 13A shows end view of first end of the alternative embodiment of the device shown in FIG. 12.

FIG. 12 shows an exploded view of the alternative embodiment. The extension bar 101 shown in FIGS. 11 and 12 is a single unit which has a first 102 and second end 101 which are connected by a shaft 104. A housing 30 has an opening extending throughout the length of the housing and the housing 30 surrounds the shaft 104 of the extension bar 101. The housing 30 is rotatably mounted onto the extension bar 101 and allows the extension bar 101 to rotate within the housing 30. The housing 30 may have an inner surface 34 made of a bushing material. One or more retaining devices 50 may be utilized to retain the housing 30 onto the extension bar 101. Bushings are used as a friction reducing device 100 for the embodiment shown in FIG. 12. The second end 110 of the extension bar 101 is a female receiving unit 111 which has a cylindrical outside diameter shape 112, with a hexagon shaped recession 113. The first end 102 of the extension bar 101 defines a square recess 103 therein for receiving a square head of a socket wrench or power tool 70. The recessions 103. 113 present on the first and second ends 102, 110 of the extension bar each open into a chamber 105 that extends throughout the shaft 104 of the extension bar 101 as can be seen in FIG. 13. FIGS. 13A and 13B show views of the first 102 and second 110 ends of the alternative embodiment of the device shown in FIGS. 11, 12 and 13.

The second end 110 of the extension bar 101 is capable of receiving a variety of additional tools or adaptors. The second end 110 of the extension bar 101 can accept a tool with a coupling mechanism with a detent present on the sidewall of the hexagonal shaped recession 113, which would allow it to couple with such a coupling mechanism.

The embodiment of the device disclosed in FIGS. 11 and 12 discloses a chamber 105 which connects the recessions on the first and second ends 102, 110 of the extension bar 101. If the additional tools or adaptors which fit into the second end 110 of the extension bar are elongated, then the presence of the chamber 105 within the shaft 104 allows the device to accommodate the tool or adaptor.

Figure 14:
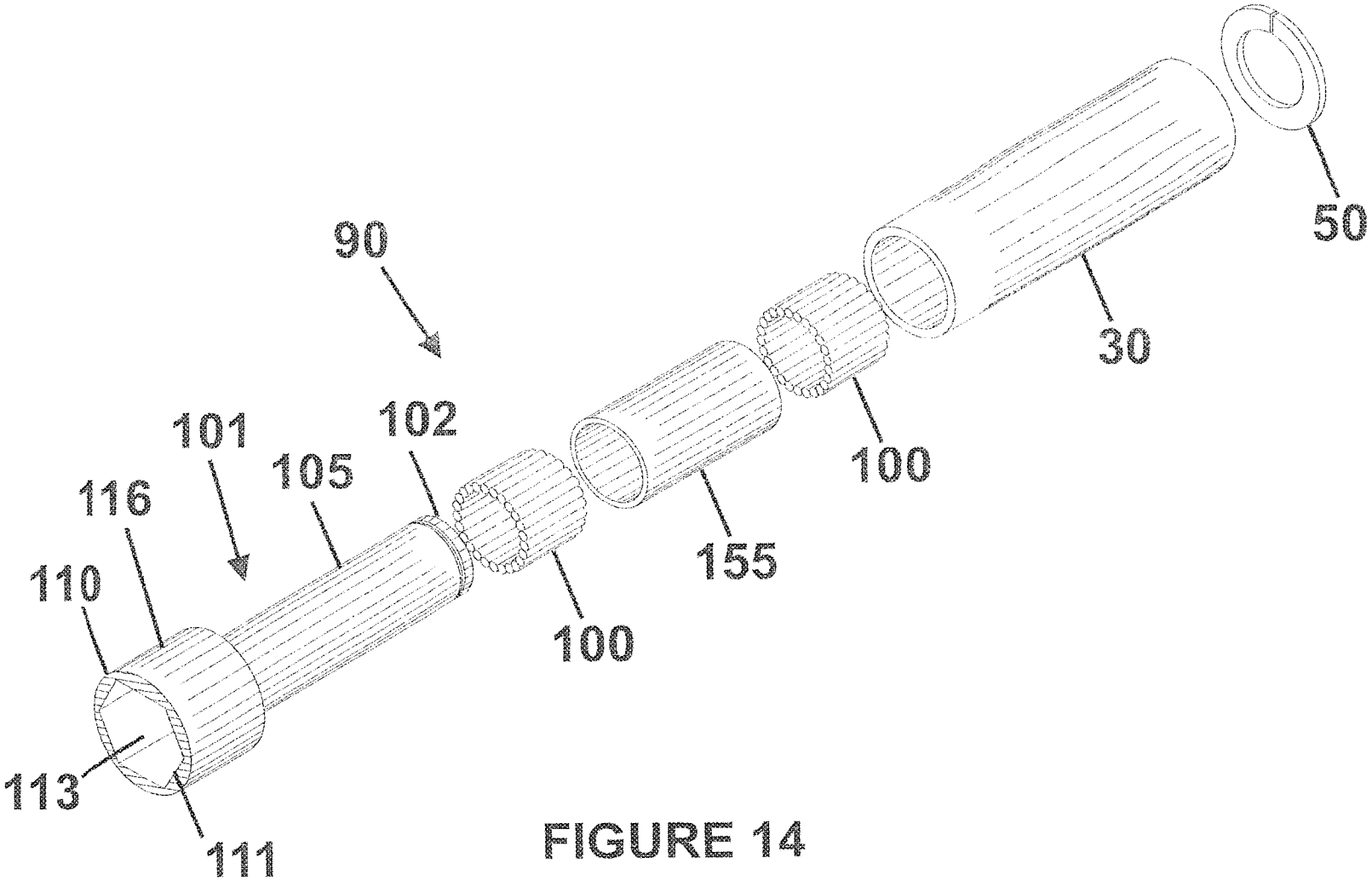
FIG. 14 shows an exploded view of an alternative embodiment of the device.
Figure 15:
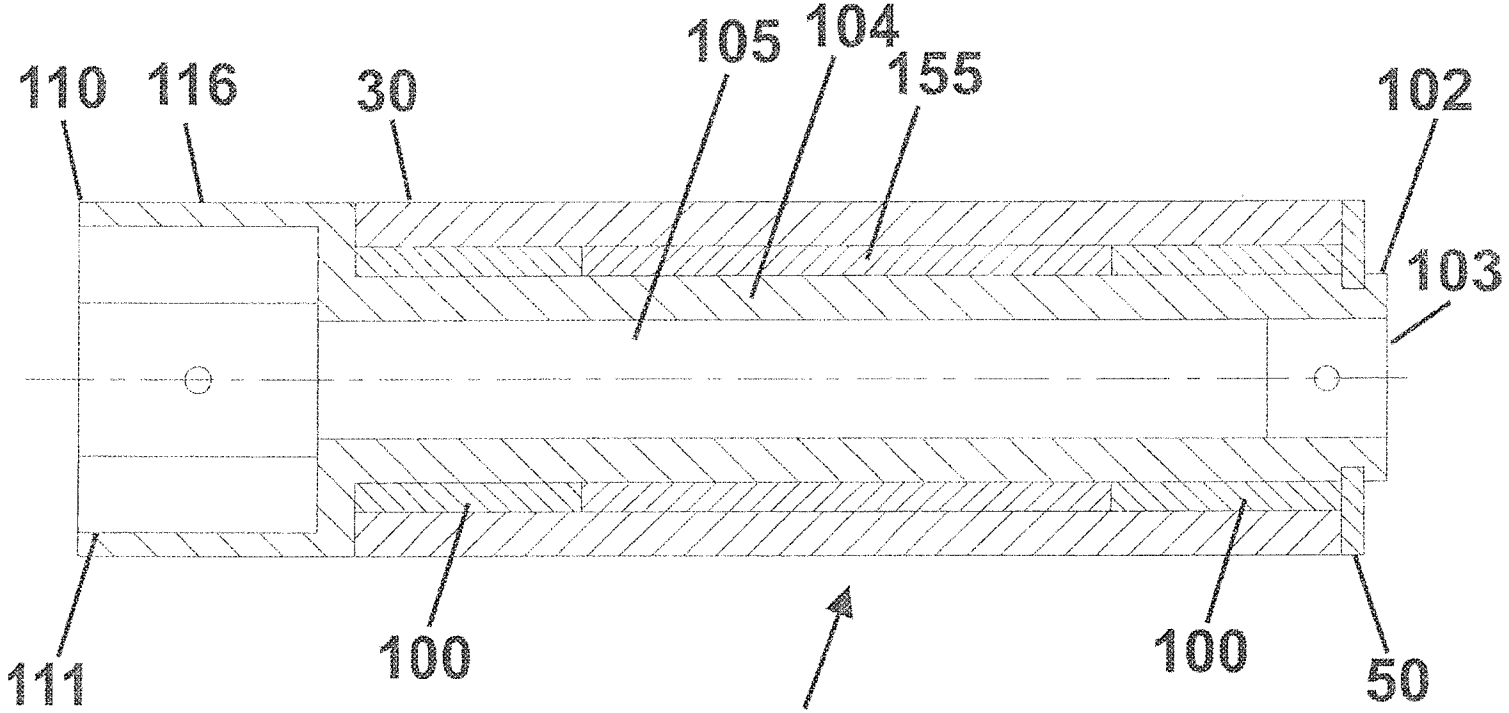
FIG. 15 shows cut-away side view of an alternative embodiment of the device.

Another alternative embodiment of the device is shown in FIG. 14. In this embodiment, the extension bar 101 also has a first and second end 102, 110 connected by a shaft 104. A tubular housing 30 surround the shaft 104 of the extension bar 101 and is rotatably mounted onto the shaft 104. In this embodiment of the device, the second end 110 of the extension bar 104 has an enlarged head 116 which forms a female receiving end 111. The enlarged head 116 may have a cylindrical outside diameter shape 112 with a hexagon shaped recession 113 that connects to a chamber 105 that extends throughout the shaft 104 of the extension bar 101 through to the first end 102 of the extension bar 101, as can be seen in FIG. 15. The second end 32 of the housing 30 sits flush against the enlarged head 116 of the second end 102. The enlarged head 116 serves to retain the housing 30 on the extension bar 101. The female receiving end 111 is capable of receiving a variety of additional tools or adaptors. The first end 102 of the extension bar 101 defines a square recess 103 therein for receiving a square head of a socket wrench 79 or power tool 70.

Figure 16:
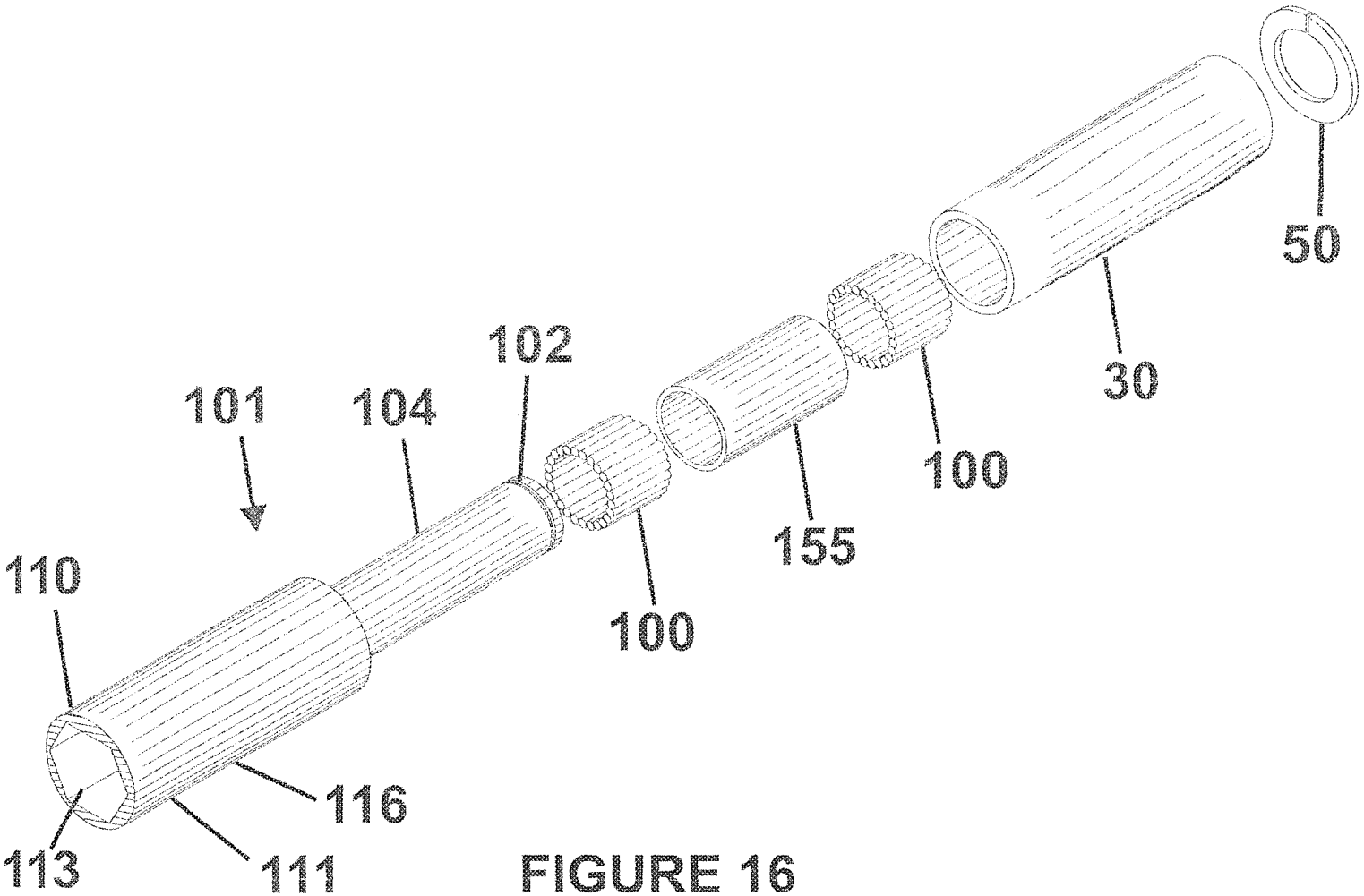
FIG. 16 shows an exploded view of an alternative embodiment of the device.
Figure 18B:
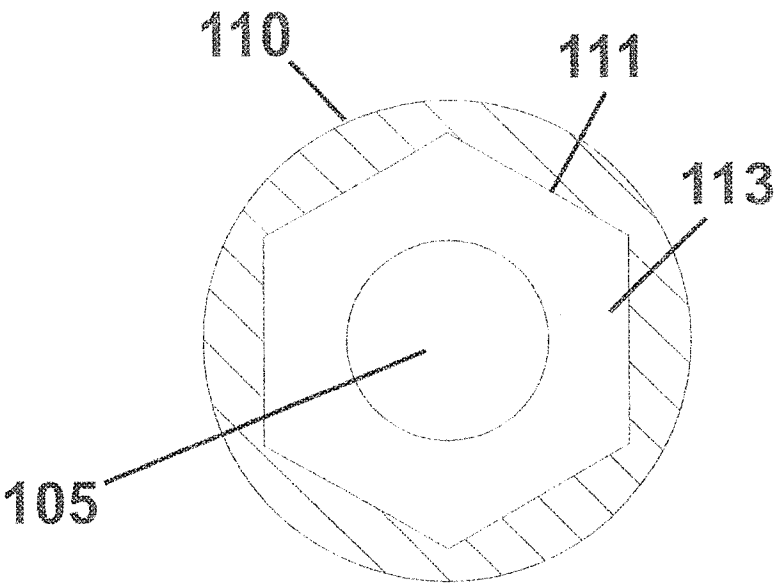
FIG. 18B shows end view of second end of the alternative embodiment of the device shown in FIG. 16.
Figure 18A:
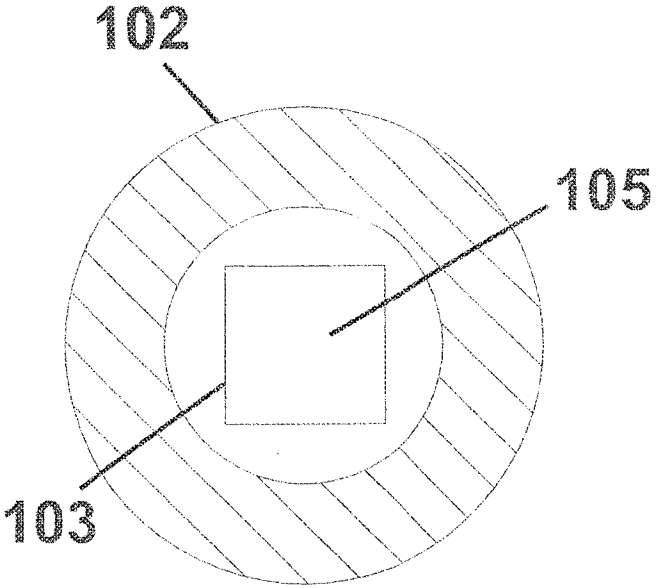
FIG. 18A shows end view of first end of the alternative embodiment of the device shown in FIG. 16.
Figure 20:
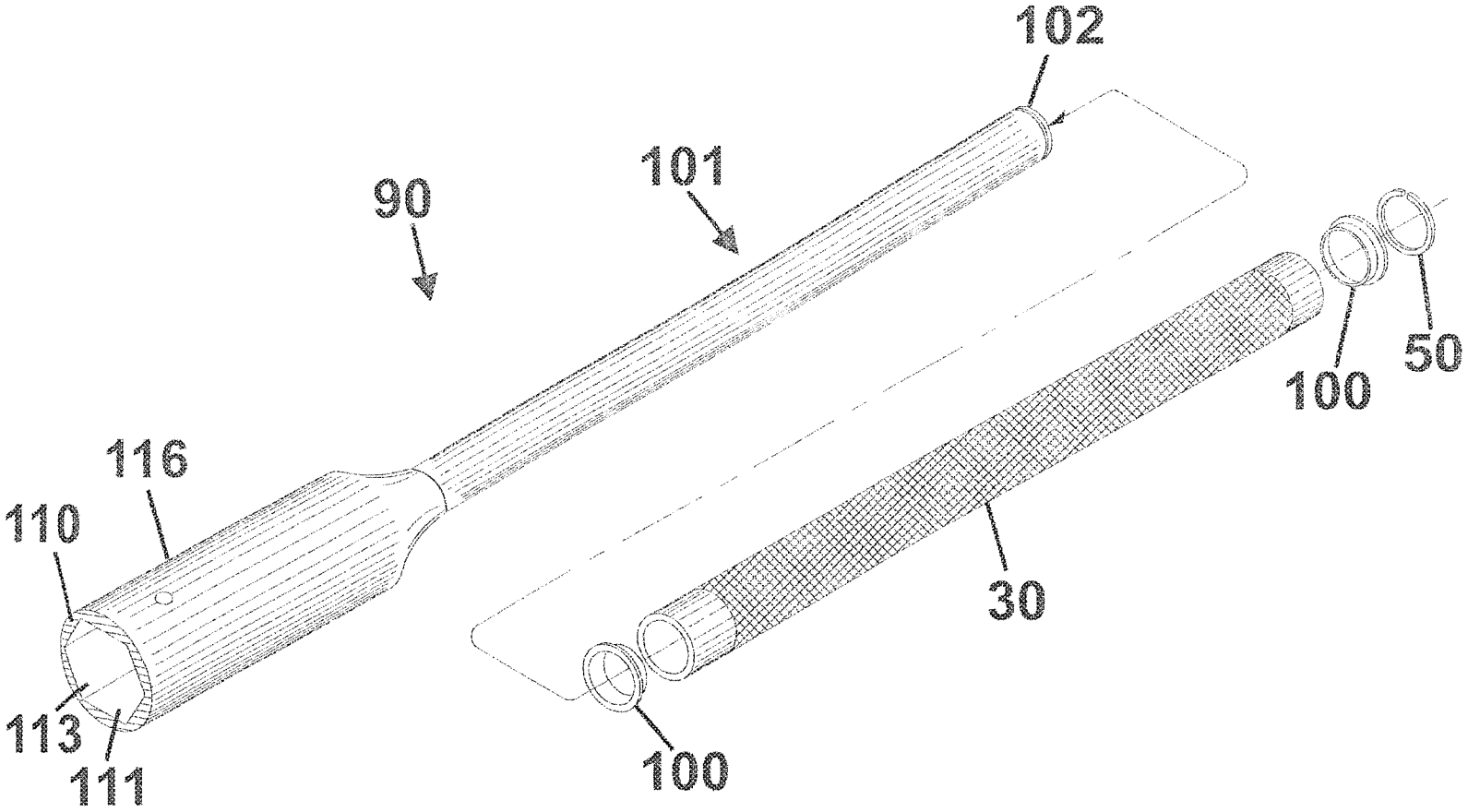
FIG. 20 shows an exploded view of an alternative embodiment of the device.

FIGS. 16 and 20 show alternative embodiments of the device. These embodiments of the device each have an extension bar 101 with a first and second end 102, 110 which are connected by a shaft 104L On each of the embodiments, a housing 30 is rotatably mounted onto the extension bar 101. The housing 30 may be comprised of a bushing material itself, or a friction, reducing device 100 may be used to rotatably mount the housing 30 onto the shaft 104 of the extension bar 101. The extension bar 101 is capable of rotation within the housing 30. On each of the embodiments of the device shown in FIGS. 16 and 20, the first end 102 of the extension bar 101 defines a square recess 103 therein for receiving a square head of a socket wrench 79 or power tool 70. FIG. 17 shows the alternative embodiment shown in FIG. 17 in use in conjunction with a ratchet tool. Also shown in FIG. 17 is a magnet 115 incorporated into the wall of the enlarged head 116 of the second end 102 which is used to assist in the retaining of additional tools or adaptors designed to fit within the second end of the extension bar 101. FIGS. 18A and 18B show an end view of the first and second end 102, 110 of the alternative embodiment shown in FIG. 16, respectively. On the second end 110 of the extension bar is a female receiving unit 111 which is comprised of an enlarged head 116 with a hexagon shaped recession 113.

Figure 19:
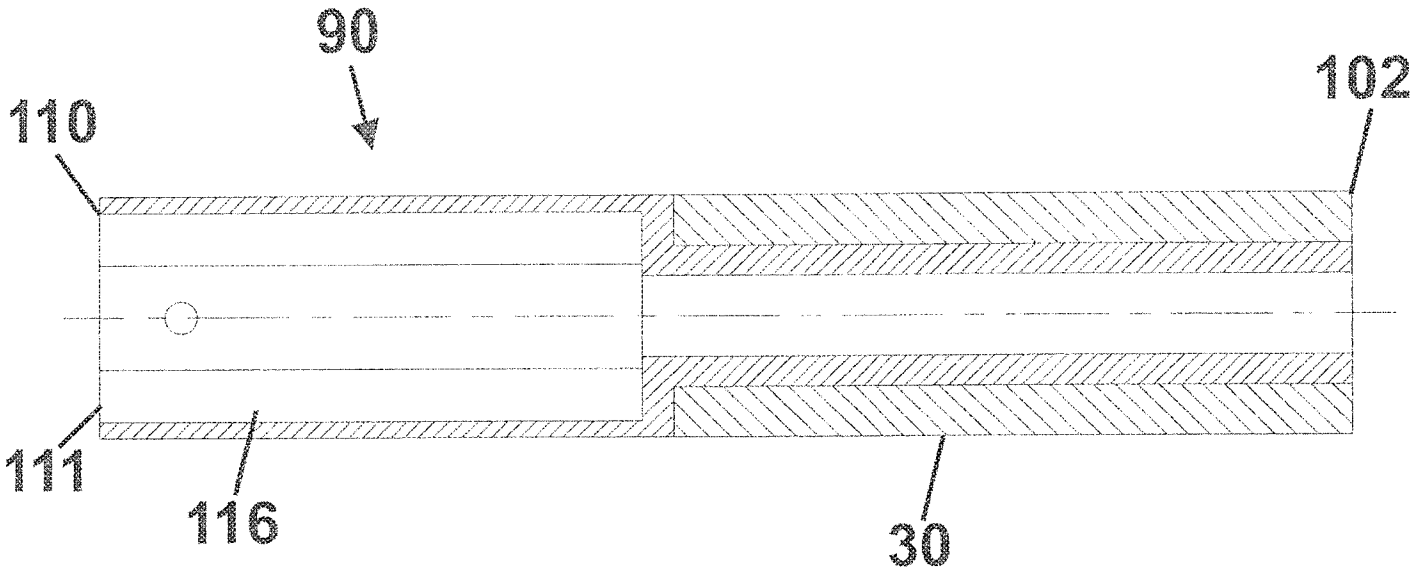
FIG. 19 shows a cut-away side view of the alternative embodiment of the device shown in FIG. 16.

As is shown in FIG. 19, which is a cut-away view of the alternative embodiment, the depth of the female receiving unit 111 is deeper than previously identified versions, allowing its use with tools or adaptors having a variety of functions. The depth of the enlarged head 116 and the recession 113 within the female receiving unit 111 can vary.

In FIG. 20, the extension bar 101 has a slenderized and extended shaft 104 connecting the first and second end 102, 110. The housing 30 is designed to match the slenderized and extended shaft 104 of the extension bar 101. Both of these alternative embodiments have a chamber 105 which extends from the first end 102 of the extension bar 101 though to the second end 110 of the extension bar 101, as is shown in FIG. 19. The enlarged head 116 present on the second end 110 of the alternative embodiments shown in FIGS. 16 and 22 allow the second end 110 to more readily receive various adaptors of different lengths and sizes.

Figure 21:
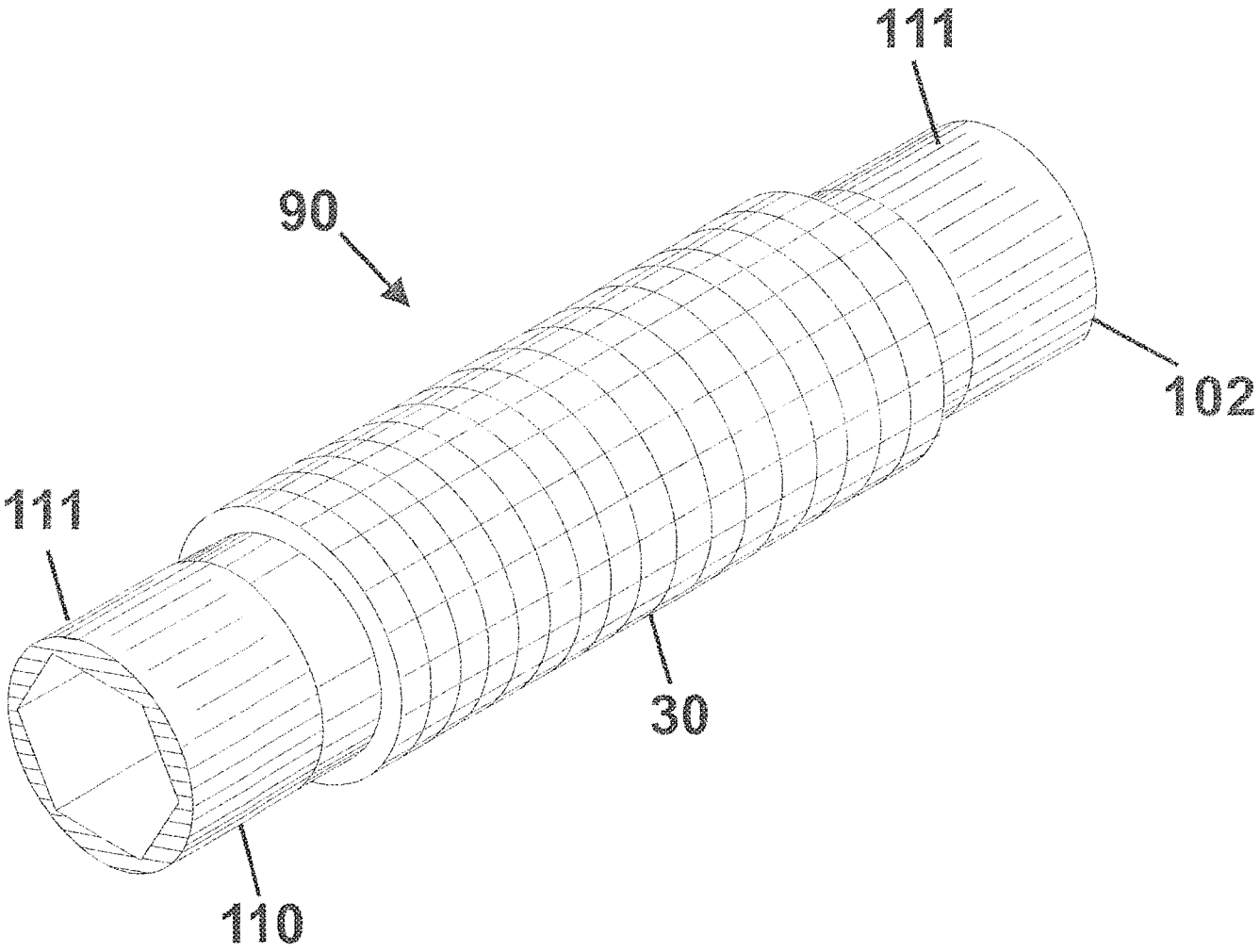
FIG. 21 shows a perspective view of an alternative embodiment of the device.

Another alternative embodiment of the device is shown in FIG. 21. In this embodiment, a tubular housing 30 surrounds the shaft 104 of the extension bar 101 and is rotatably mounted onto an extension bar 101. The extension bar 101 in this embodiment has a shaft 104 structure having a first and second end 102, 110. In this embodiment, each of the first and second ends 102, 110 of the shaft 104 structure consists of a female receiving unit 111, which are capable of receiving various adaptors which serve to enlarge the functionality of the device. Both of the ends 102, 110 of the extension bar 101 have enlarged heads 116 which serve to retain the housing 30 on the extension bar 101. The tubular housing 30 may be rotatably mounted onto the shaft 104 structure by any type of friction reducing device 100, such as bearings, bushings or other similar type of device. The shaft 104 structure of this embodiment may be formed by joining two or more individual shaft sections together in a variety of ways to form a complete shaft. A sampling of how the shaft structure may be comprised is discussed below in the several specific embodiments disclosed.

Figure 22:
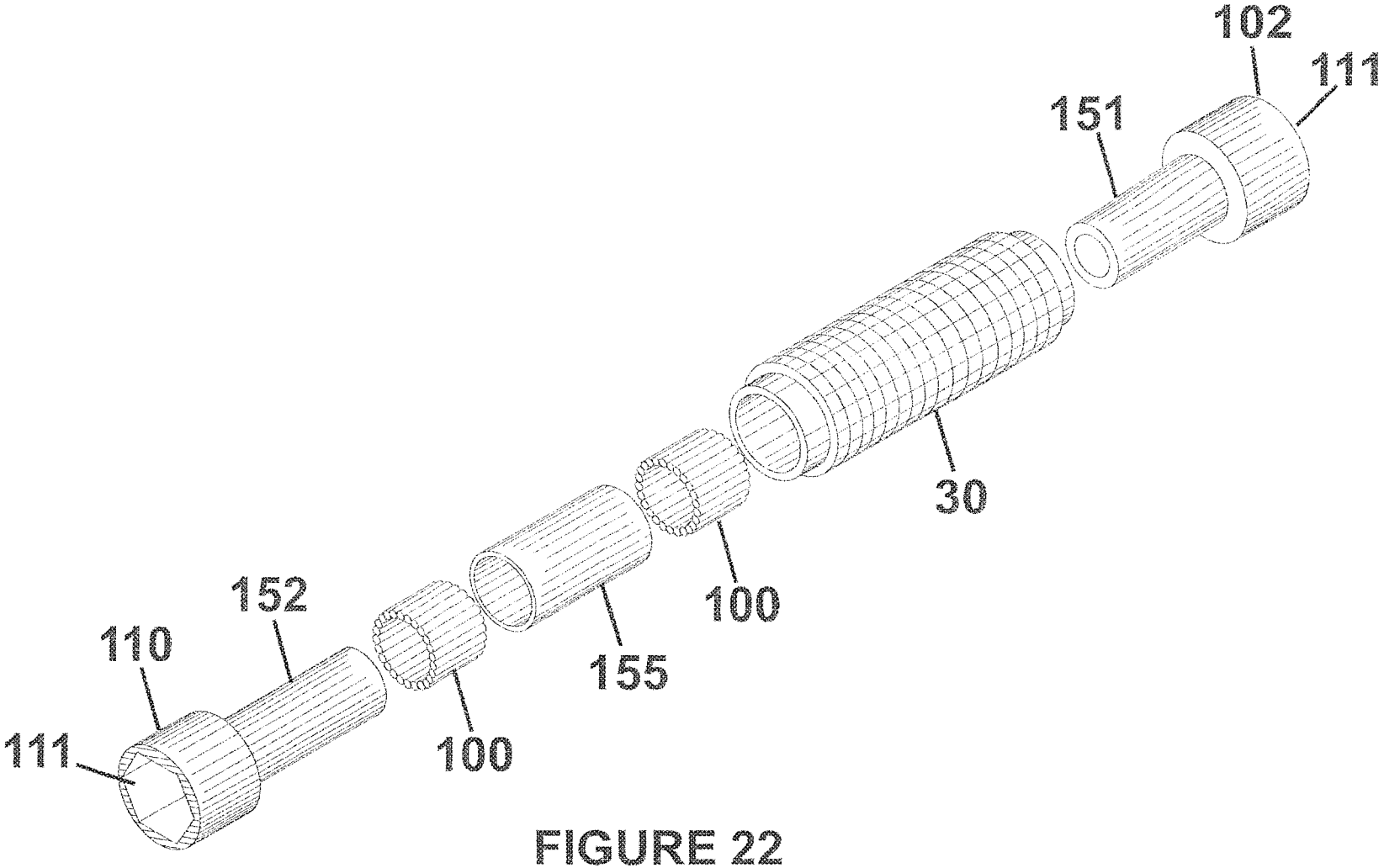
FIG. 22 shows an exploded view of an alternative embodiment of the device.

In one embodiment, which is shown in FIG. 22, a connector sleeve 155 is utilized to join the two individual shaft sections to form a shaft. The connector sleeve 115 is a circular and hollow unit sized to fit within the inner surface 34 of the housing 30 and used to space apart the friction reducing devices 100, which are typically placed on either end of the connector sleeve 155, In this embodiment, the shaft 104 is comprised of a first and second shaft sections 151, 152, which each extend from the first and second ends 102, 110 which are both female receiving ends 111. The diameter of the first and second shaft sections 151, 152 are sized to have a precision sliding fit through the inside round opening of the friction reducing device 100 and through one end of the connector sleeve 155. The first and second shaft sections 151, 152 are force pressed into the slightly smaller openings of the connector sleeve 155. Each of the first and second shaft sections 151, 152 are pressed approximately half way into the connector sleeve 155. The diameter of the connector sleeve 155 is designed to receive the first and second sections of the shaft 151, 152 through means of a high pressure force. When the first and second shaft sections 151, 152 are pressed into the housing 30 and into the connector sleeve 155, they form a shaft 104.

Figure 23:
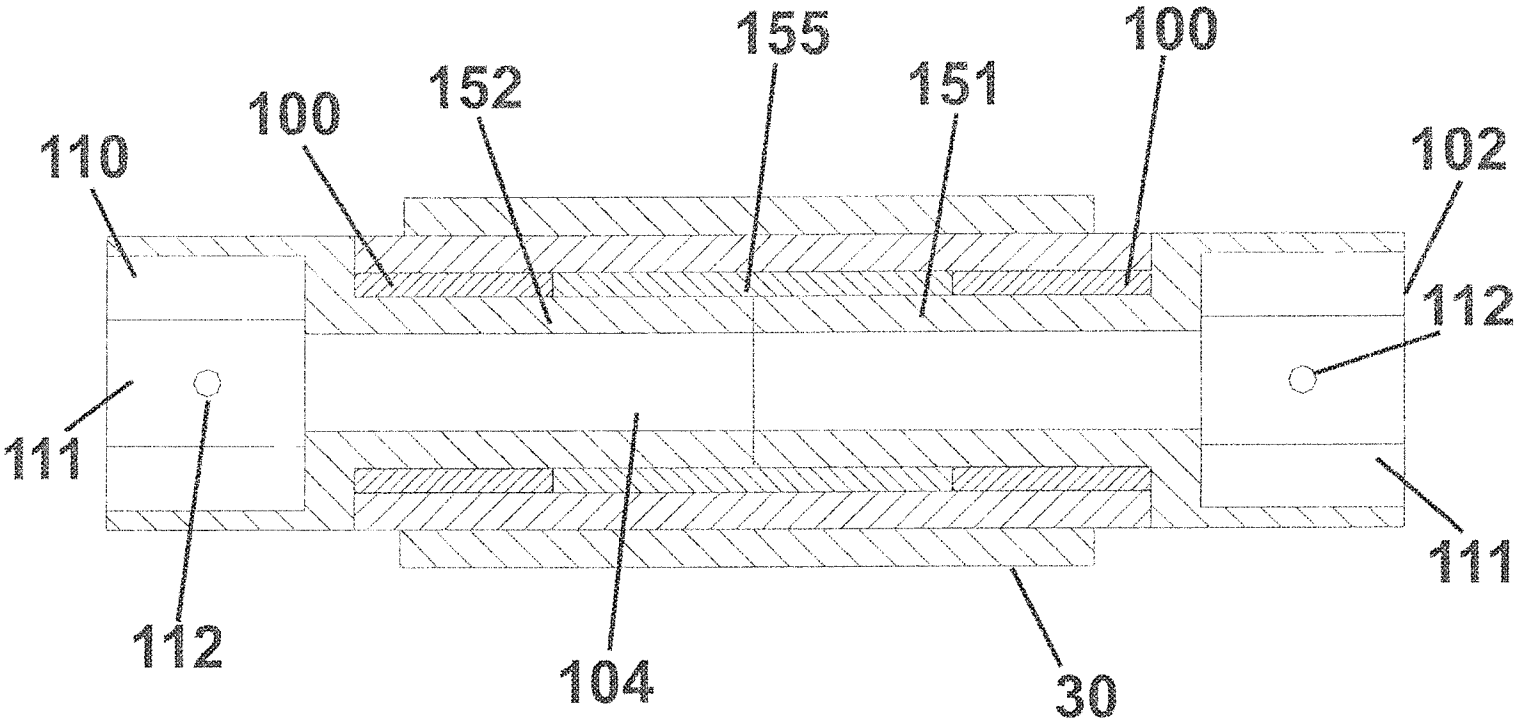
FIG. 23 shows a cut-away side view of the alternative embodiment of the device shown in FIG. 22.

The female receiving units 111 have a circular shaped outer periphery 112 with a hexagon shaped recession 113. Each of the recessions 113 connect with a chamber 105 that extends from the recessions 113 through the first and second shaft sections 151, 152 respectively as is shown in FIG. 23. Each of the female receiving ends 111 is capable of receiving an additional tool or an adaptor.

Figure 24:
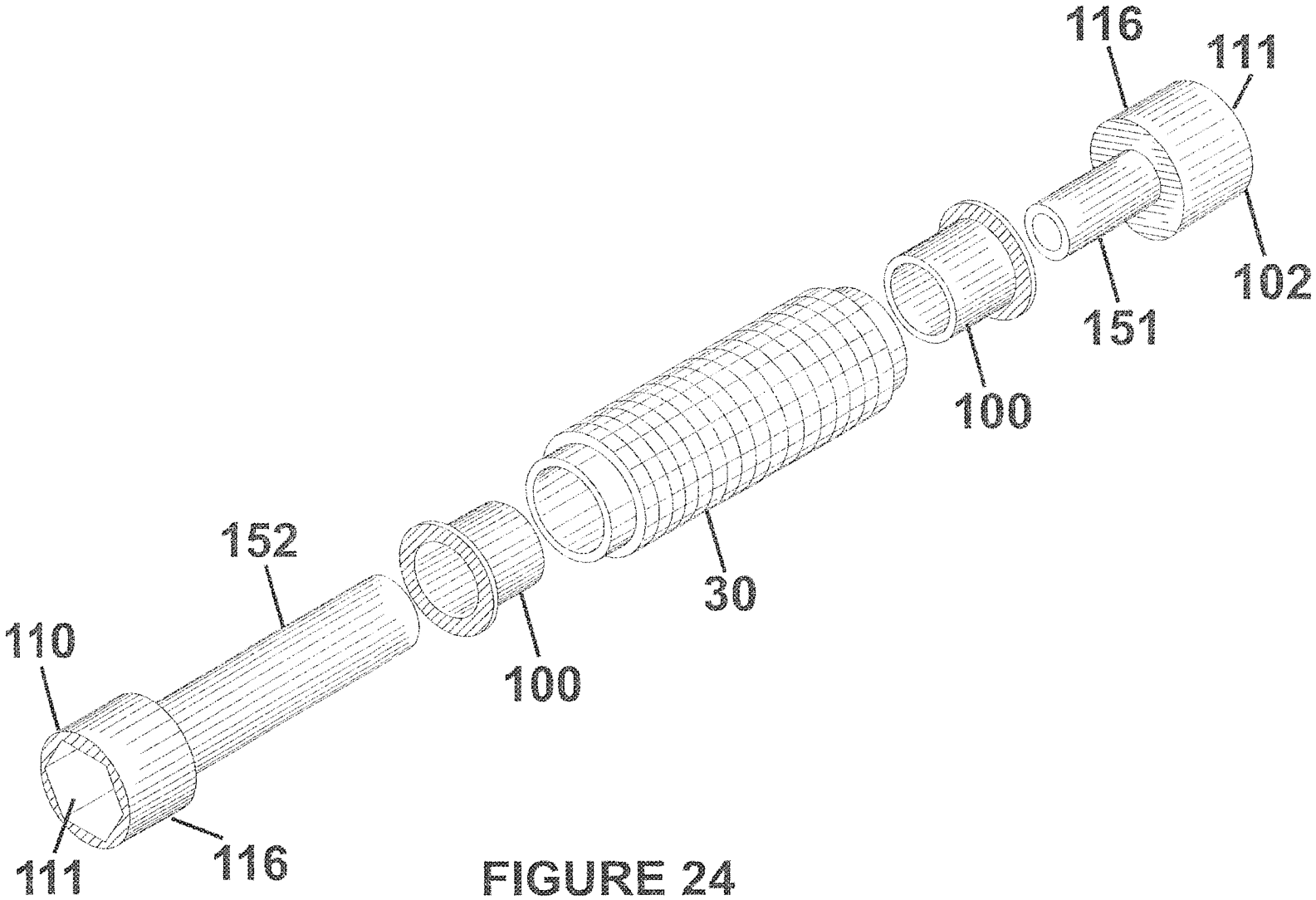
FIG. 24 shows an exploded view of an alternative embodiment of the device.

Another alternative embodiment of the device is shown in FIG. 24, which also utilizes two individual shaft sections 151, 152 to form a shaft 104 with female receiving units 111 on each end, similar to the embodiment shown in FIG. 22. In the embodiment shown in FIG. 24, a connector sleeve 155 is not utilized but rather the shaft is again comprised of a first and second shaft section 151, 152 which each extend from the first and second female receiving units 111 respectively. The first shaft section 151 is sized so that it has a smaller diameter than the second shaft section 152. The second shaft section 152 is hollow and may by longer in length than the first shaft section 151. Thus, as is shown in FIG. 24, the first shaft section 151, which is shorter in length and smaller in diameter than the second shaft section 152, will press fit into the second shaft section 152, thus fitting the shaft sections 151, 152 together to form a single shaft 104. In this embodiment, a housing is also rotatably mounted on the shaft and a variety of friction reducing devices 100 may be used to rotatably mount the housing 30. In FIG. 24, bushings are utilized.

Figure 27A:
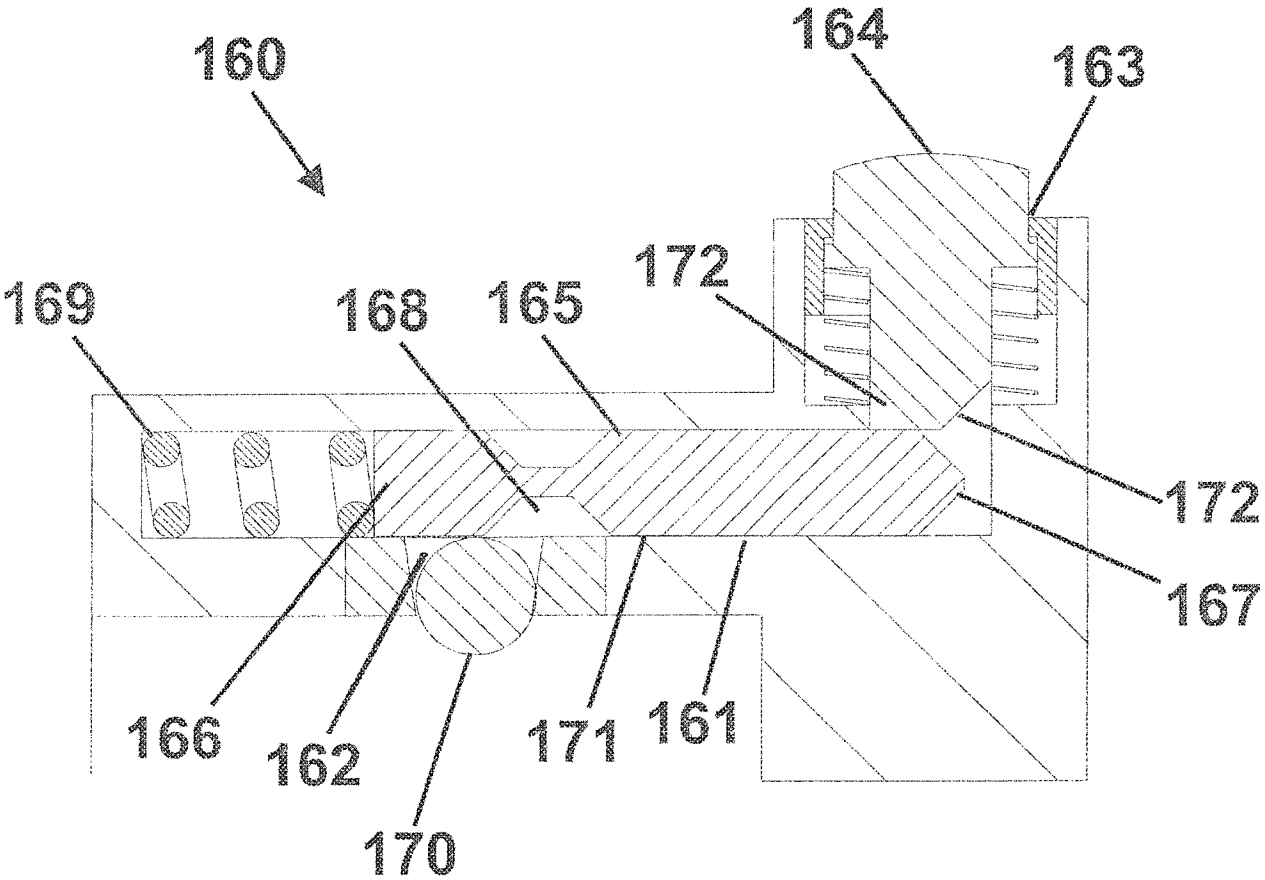
FIG. 27A shows cut-away view of the coupling mechanism present on the adaptors in relaxed position.
Figure 27B:
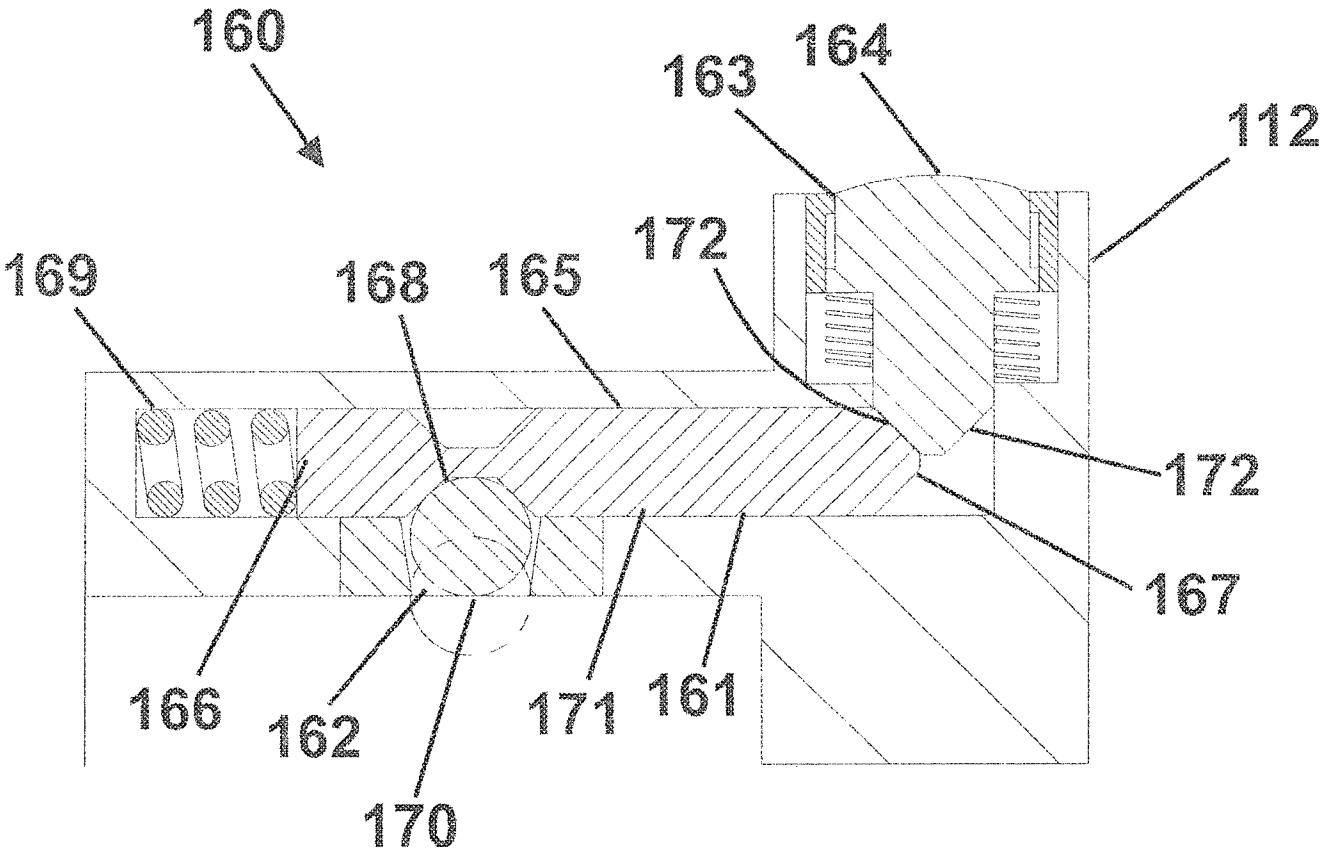
FIG. 27B shows cut-away view of the coupling mechanism present on the adaptors in depressed position.

The female receiving units 111 each have a hexagon shaped recession 113 which meets with a chamber 105 extending into the first and second shaft sections 151, 152. Each of the female receiving ends 111 is capable of receiving an additional tool or an adaptor to enlarge the functionality of the tool. Additionally, each of the female receiving units have a detent to receive the ball 140 of a coupling mechanism similar to the one shown in FIGS. 27A and 27B.

Figure 25:
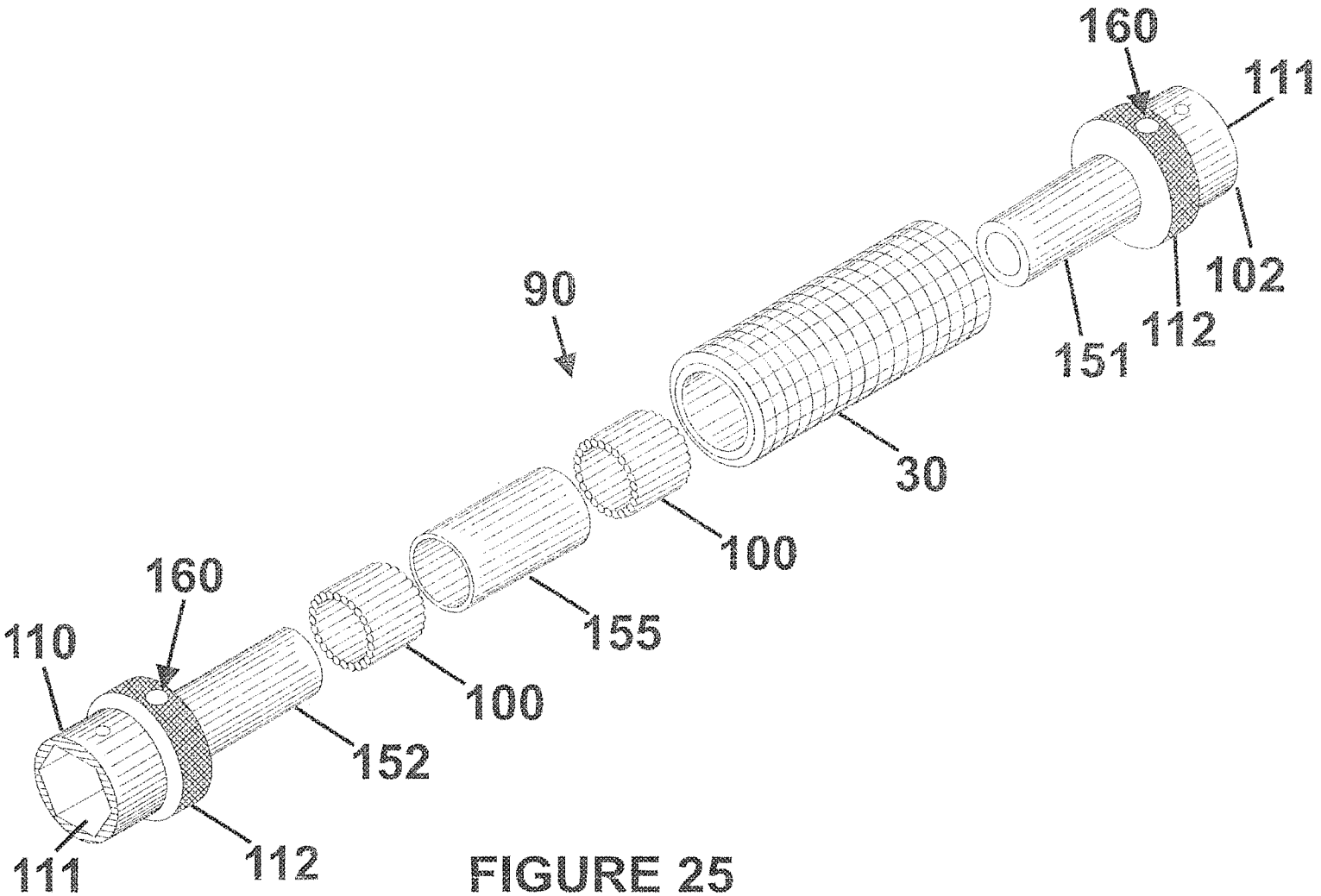
FIG. 25 shows an exploded view of an alternative embodiment of the device.
Figure 26:
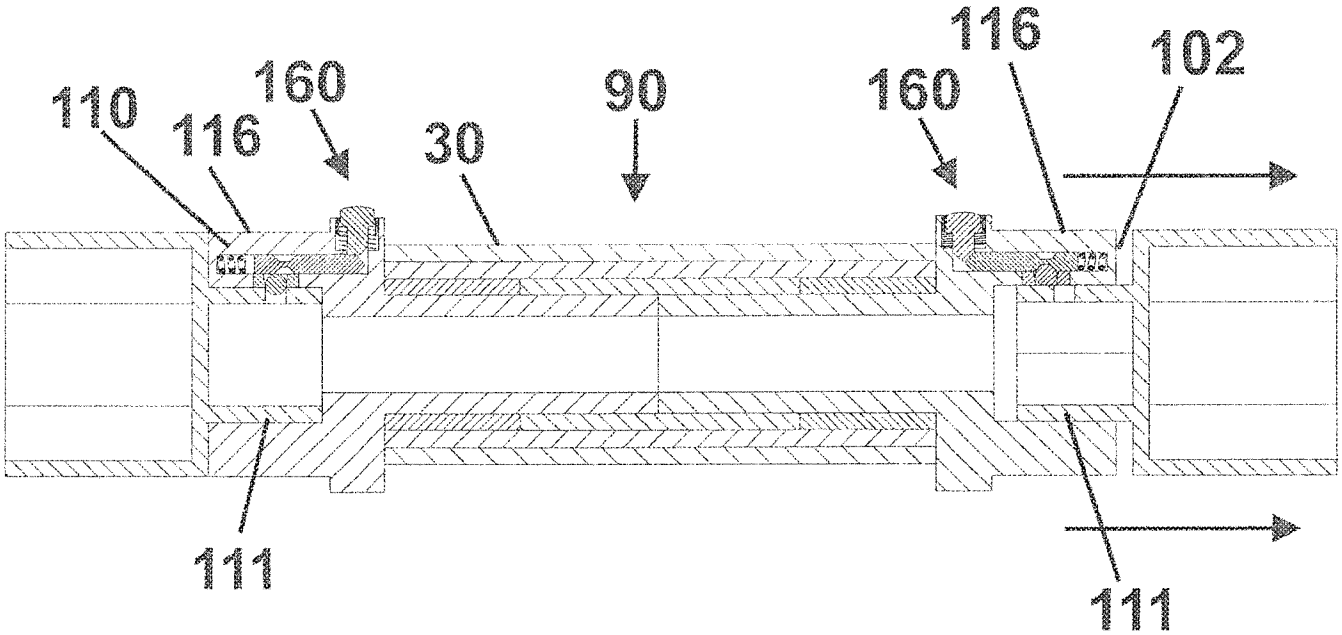
FIG. 26 shows a cut-away side view of the alternative embodiment of the device shown in FIG. 25.

In the embodiment shown in FIGS. 25 and 26, an alternative embodiment of the device is shown wherein the female receiving units 111 each have a coupling mechanism 160 incorporated into them. In this embodiment, the coupling mechanism 160 of the female receiving unit 111 mates with a detent in an adaptor or socket which is inserted into the female receiving unit 111. Each of the female receiving units 111 is composed of an enlarged head 116 and with a collar 112 which is near at least one of the first or second ends 102, 110 of the extension bar 101. A coupling mechanism 160, such as the one shown in FIGS. 27A and 27B, can be used on the female receiving unit 111. The coupling mechanism 160 includes a longitudinal chamber 161 extending from the female receiving unit 111 through the collar 112 located at the end of the enlarged head 116 of the female receiving unit. 111. A ball receiving opening 162 is present on the outer periphery 112 of the female receiving unit 111. The ball receiving opening 162 connects to the chamber 161. A press button receiving opening 163 is present on the outer periphery of the collar 112 and the opening 163 connects to the chamber 161. A press button 164 is movably mounted in the press button receiving opening 162. A drive rod 165 is slidably mounted in the chamber 161 having a first end 166 in communication with a biasing member 169 mounted in the chamber 161 between the first end 166 of the drive rod 165 and the wall 171 of the chamber 161, Near the first end 166 of the drive rod 165 is a ball receiving recess 168 aligning with the ball receiving opening 162. The second end 167 of the drive rod 165 defines a slanted surface 172 which communicates with the press button 164 and is aligned with the press button receiving opening 163. A ball 170 is movably mounted in the ball receiving opening 162 arid slidably received in the ball receiving recess 168 and protruded from the ball receiving recess 168 depending upon the location, of the drive rod 165 in the chamber 161. The press button 164 is slidably received by the slanted surface 172 of the second end 167 of the drive rod 165. The press button 164 is slidably extended from the press button receiving opening 163 or retreated into the press button receiving opening 163 depending upon the location of the drive rod 165 in the chamber 161. When the ball 170 is protruded, it is capable of mating with a detent in the adaptor 180 or socket and thus securing the adaptor 180 for use with the tool.

Figure 28:
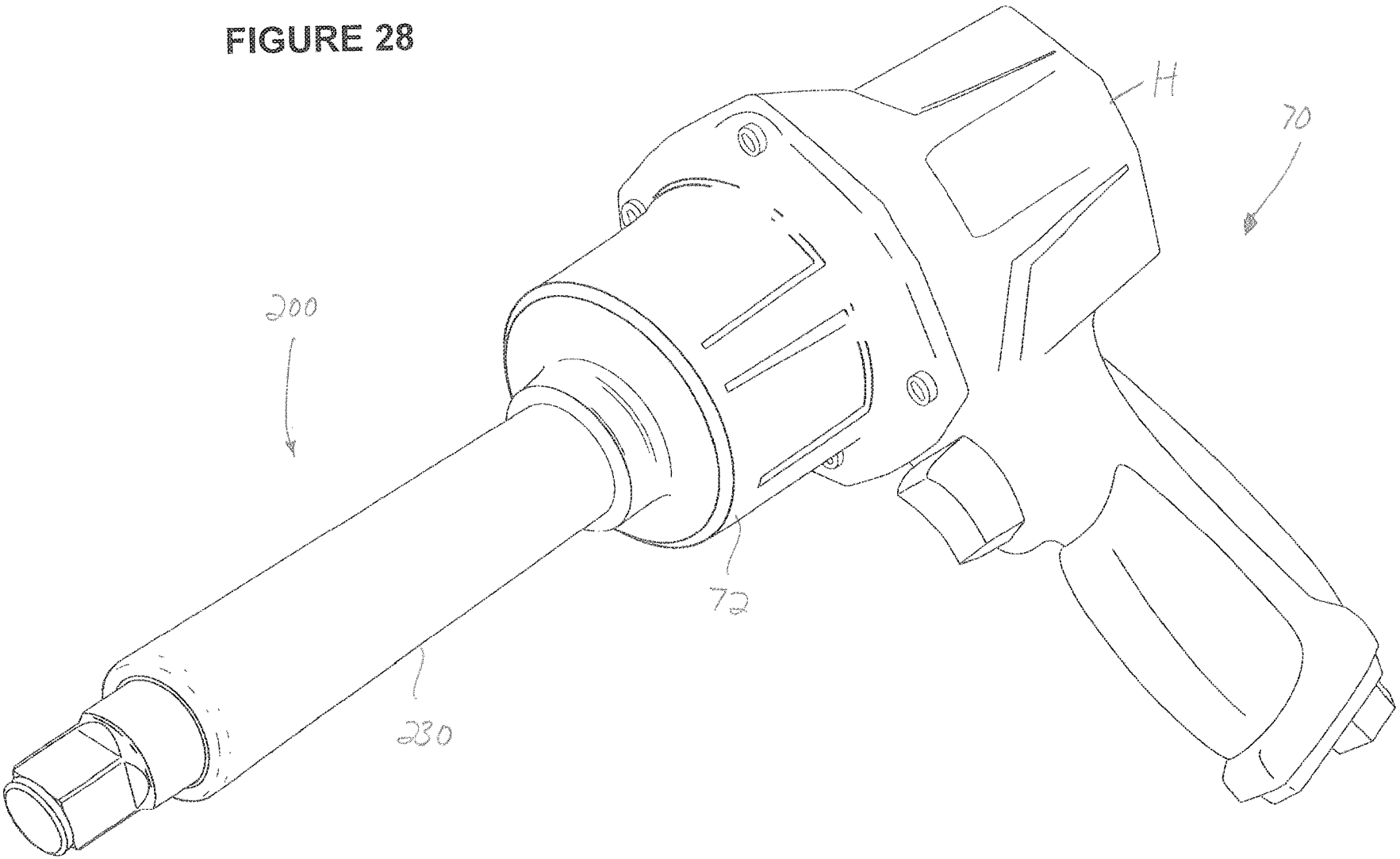
Figure 29:
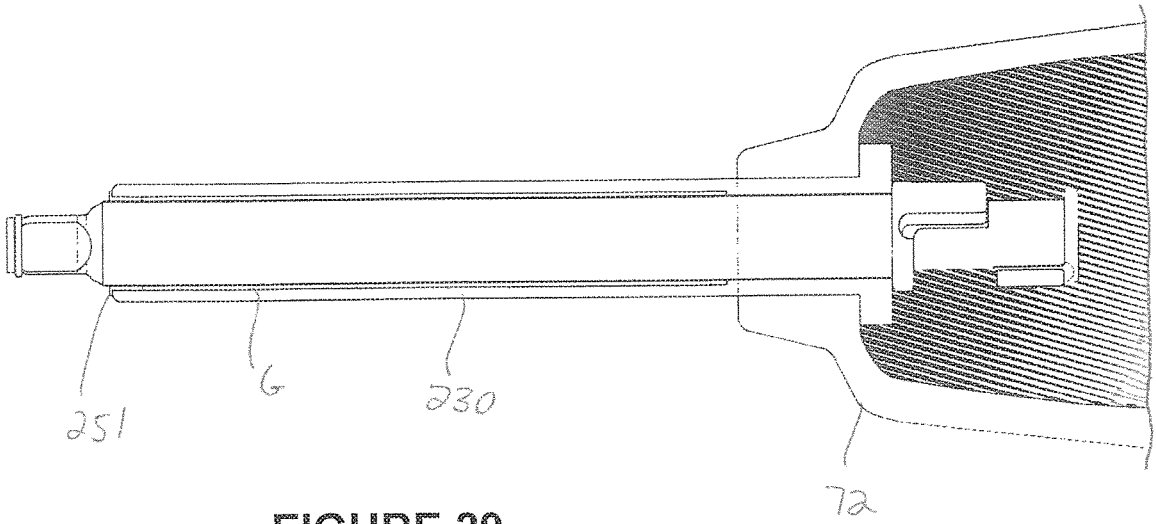
Figure 30:
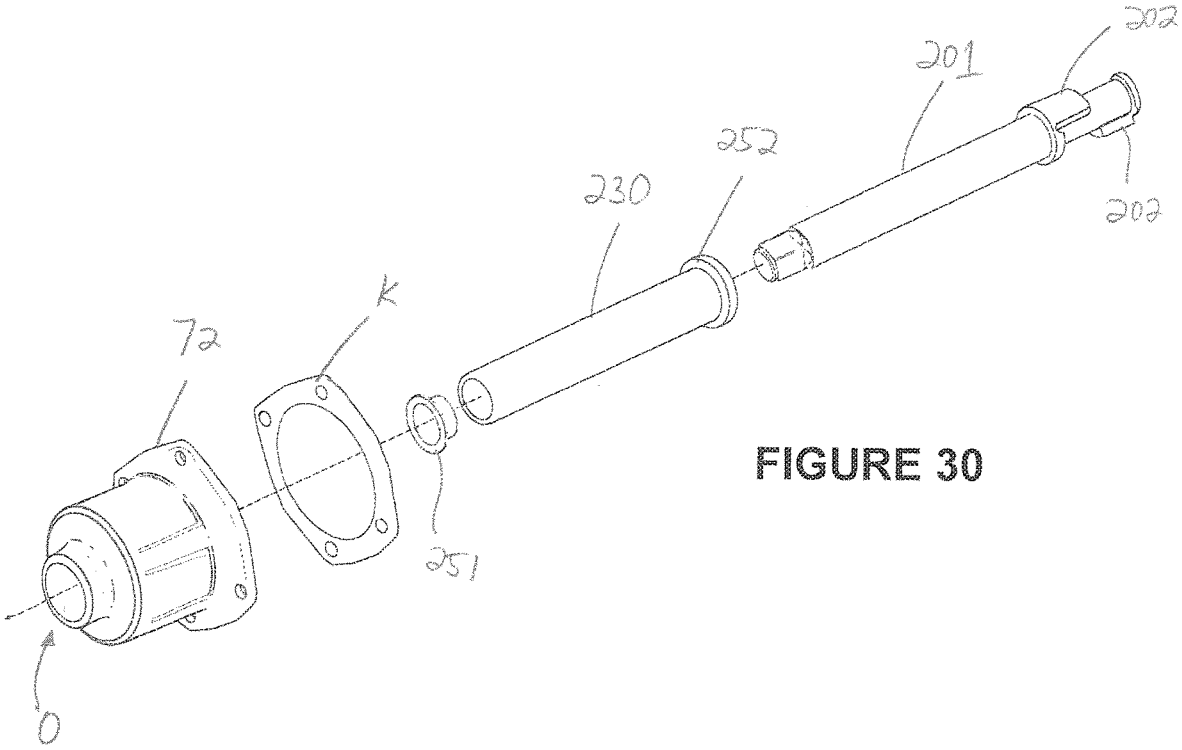

Turning now to FIGS. 28-30, a further embodiment is illustrated, which is particularly adapted for use in connection with a tool in the form of an impact tool (wrench or drill). In this embodiment, a portion of the extension apparatus 220 extends within part of a housing H of the tool 70, which may comprise an impact drill. More specifically, a nose piece 72 includes an opening O for receiving the elongated shaft 201 (sometimes called an anvil), which may include claws 202 for engaging a corresponding driver for transmitting rotary movement. The opposite end of the shaft 201 is adapted for engaging a working element, such as a socket assembly, and thus may be provided with a polygonal (e.g., square) cross-section, and possibly a detent (not shown).

Between the first and second ends, the shaft 201 rotatably carries a tubular housing forming a bushing 230, which may receive a bearing 251 at the first end for engaging the nose piece 72. A retainer 252 may be provided at the opposite end of the bushing 230 (and preferably integrally formed with it, as shown) and serve as a bearing between the rotatable shaft 201 and the housing 230. Preferably, the bushing 230 substantially matches the length of the shaft 201, but is sufficiently short to expose the working elements (e.g., male connector and claws). To accommodate the bearing 251, it should be appreciated that a gap G may be provided between the shaft 201 and the bushing 230. A gasket K may also be provided, as desired or necessary, to form a seal with the housing H of the tool 70.

Figure 31:
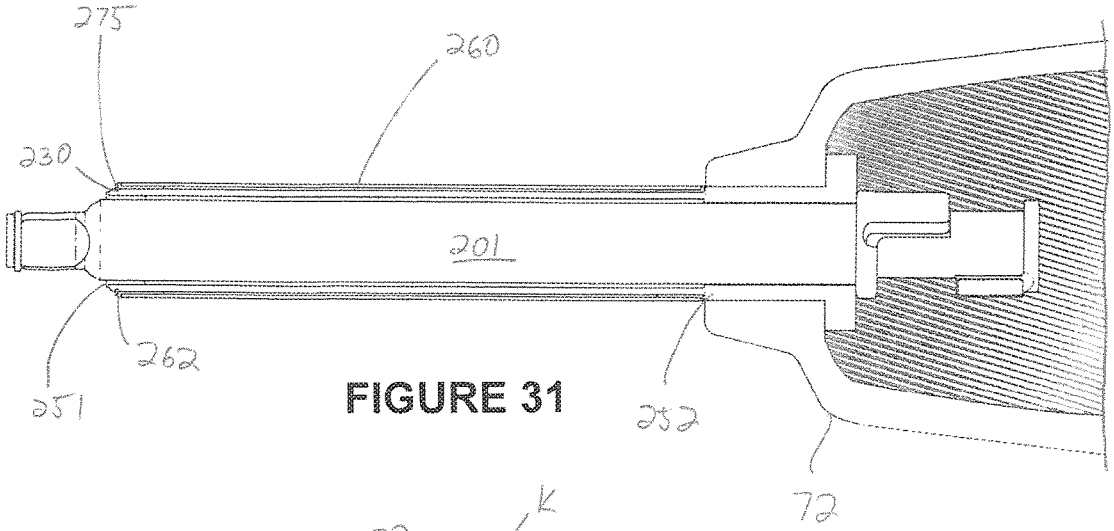
Figure 32:
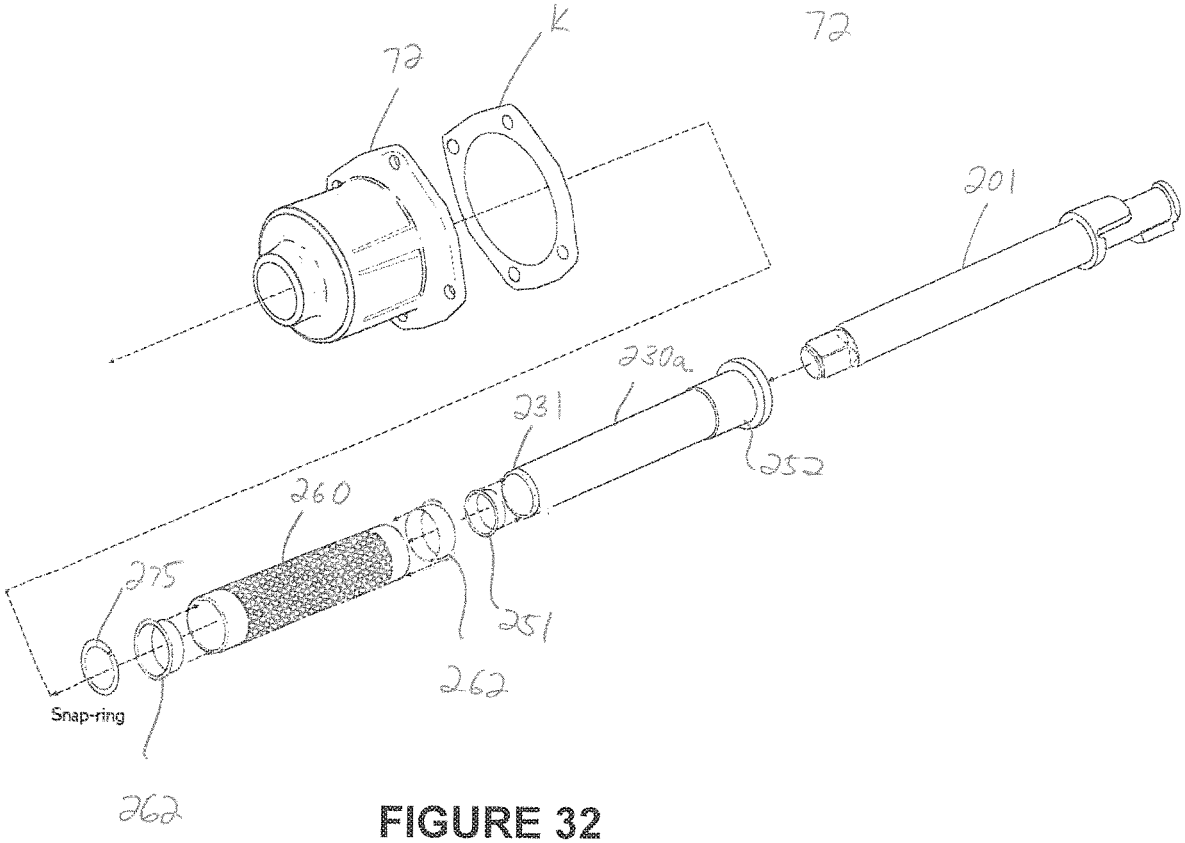

FIGS. 31 and 32 show a further embodiment, which is similar to the embodiment of FIGS. 28-30. The elongated bushing 230 in this embodiment includes a reduced portion 230*a* adjacent to a retainer 252. The reduced portion 230*a* is sized for receiving a tubular housing 260 is adapted for positioning along the undersized portion. The bushing 230 at one end may include a groove 231 for engaging a retainer 275, such as a snap ring 275, for retaining a second tubular housing 260 (which may include bushings 262 press-fit in the open ends). A bearing 251 may also be provided for serving as an interface between the rotating shaft 201 and a corresponding portion of the housing 230.

FIGS. 33 and 34 show yet a further embodiment in which the shaft 201 is adapted to receive a tubular housing 260 and a separate bushing 252, which may overlie a shoulder 201*a* against which the housing abuts in a substantially flush engagement. Otherwise, the construction is substantially as previously described.

FIGS. 35 and 36 depict an embodiment in which a tubular bushing 230 includes an oversized portion 232 for engaging an annular recess 74 in the nosepiece 72 of the tool 70. The shaft 201 passes through the tubular bushing 230, and retainers in the form of snap rings 275 retain a rotatable handle 260 and the bushing 230 in place, such as by engaging corresponding grooves 231. A separate bushing 252 may also be provided for engaging the portion of the shaft 201 within the tool 70.

Figure 37:
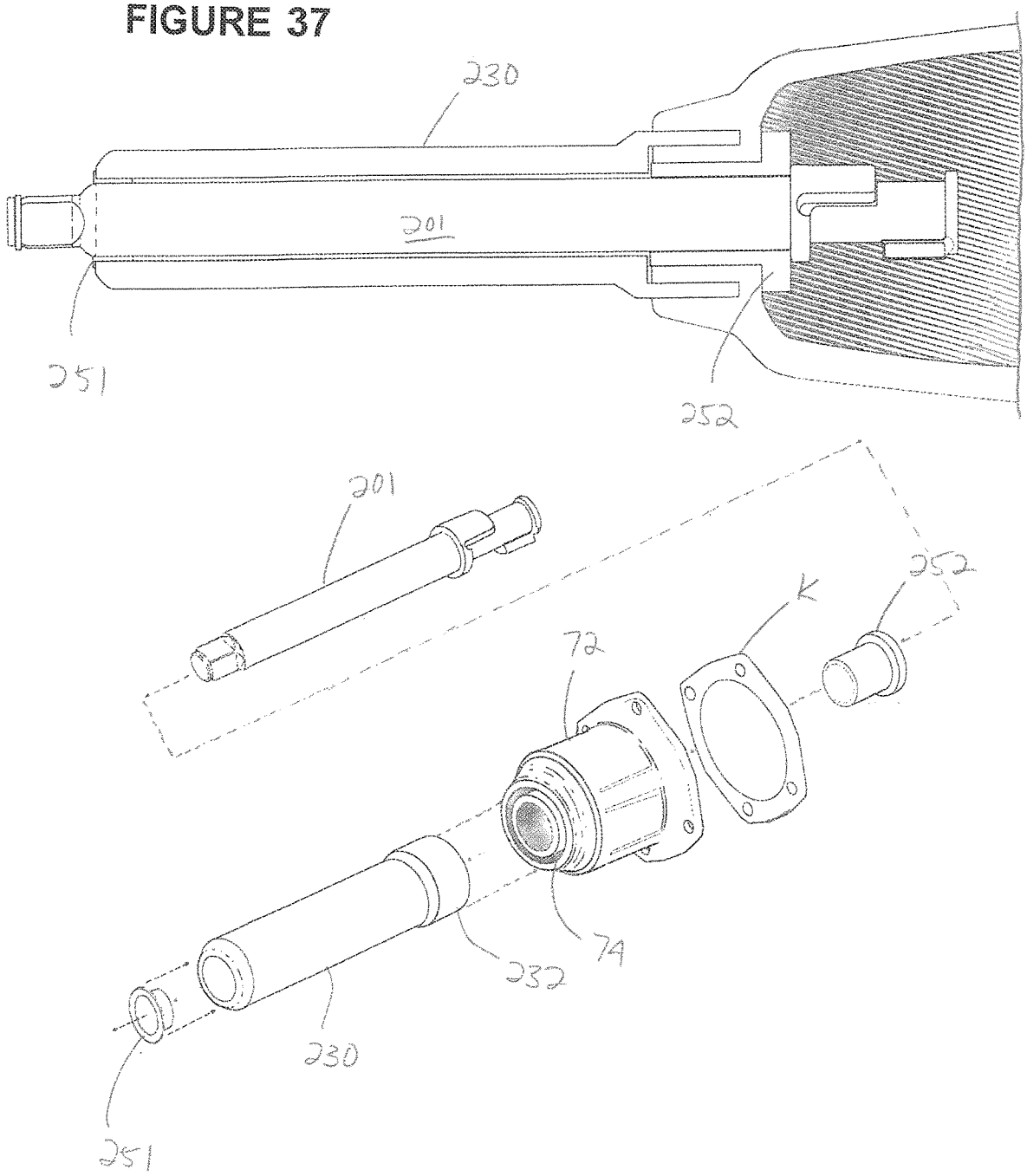
Figure 42:
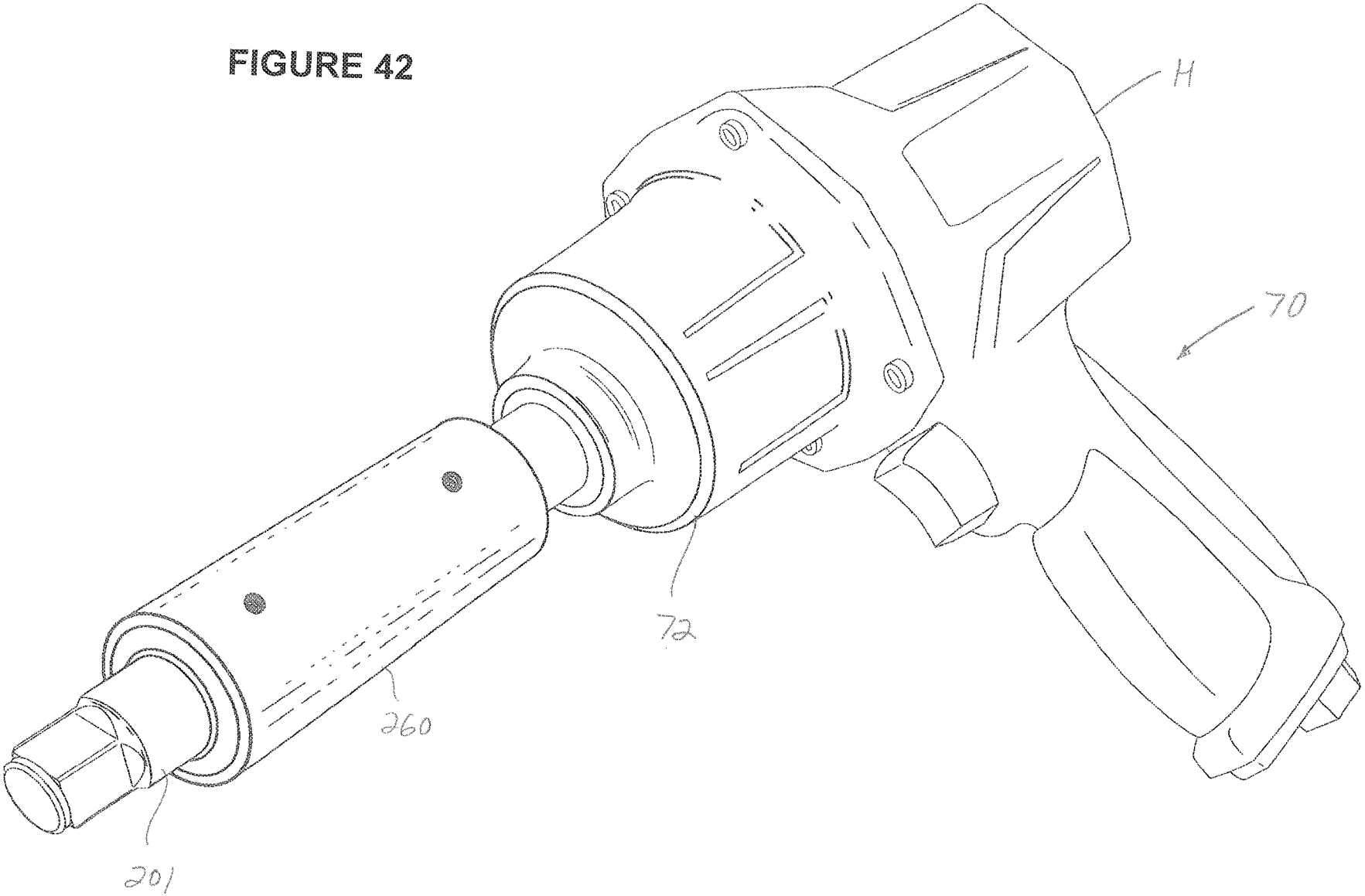
Figure 43:
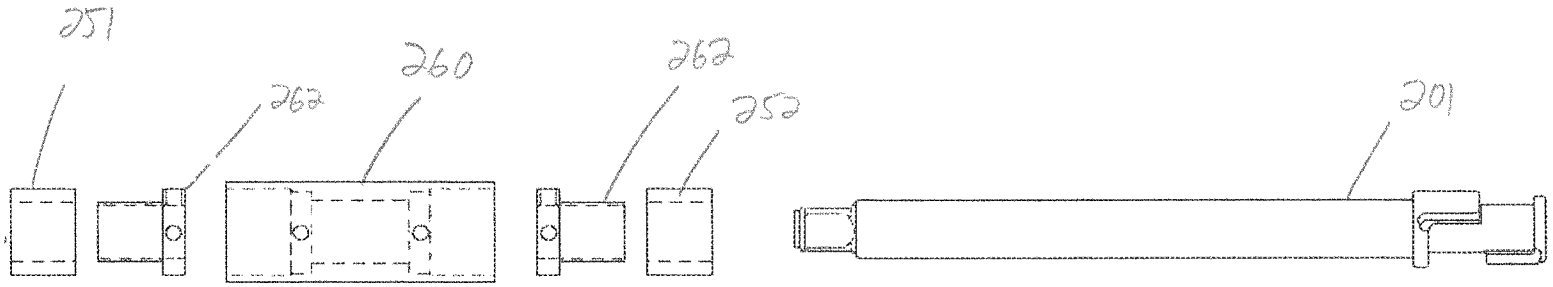
Figure 44:
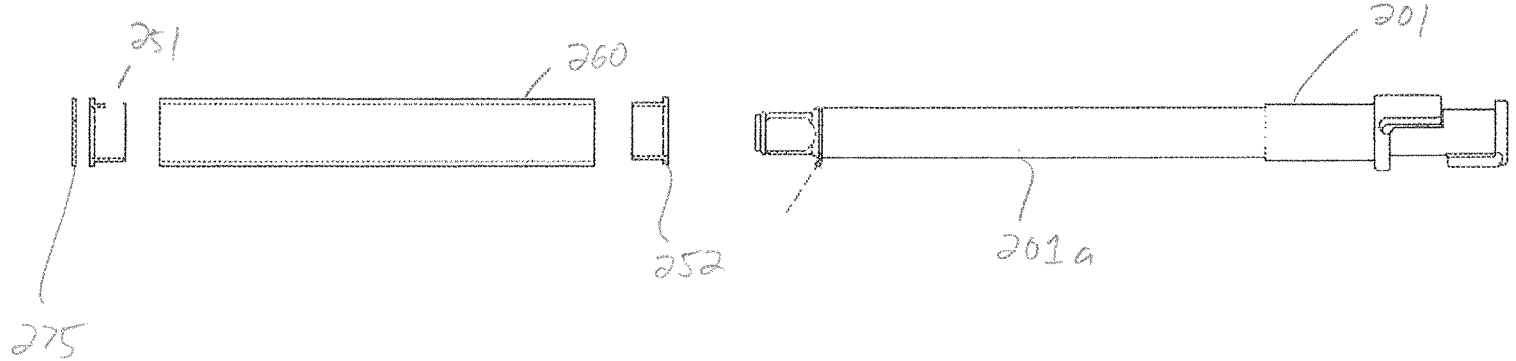

Various other embodiments are possible in light of the above teachings. For example, the embodiment of FIGS. 37 and 38 is similar to that of FIGS. 35 and 36, but omits the handle 260, bushings 262, and associated locking ring 275. FIGS. 38 and 39 show an embodiment in which the bushing 230 and nose piece 72 are unitarily formed. The same is true in the embodiment of FIGS. 40 and 41, but a handle 260 with press-fit bushings 262 is mounted over the sleeve 230 and a retainer, such as snap ring 275, is provided for retaining the handle 260. Finally, FIGS. 41-42 show an embodiment in which the handle 260 receives bearings 262 at each end (which may be fixed using transverse fasteners, such as set screws (not shown), which in turn engage further bearing elements 251, 252 for receiving the shaft 201, and FIG. 43 shows a milled shaft 201 having a reduced portion 201*a*.

Figure 46:
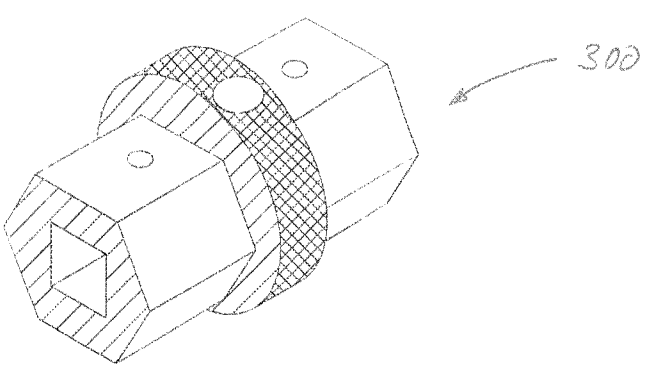
Figure 45:
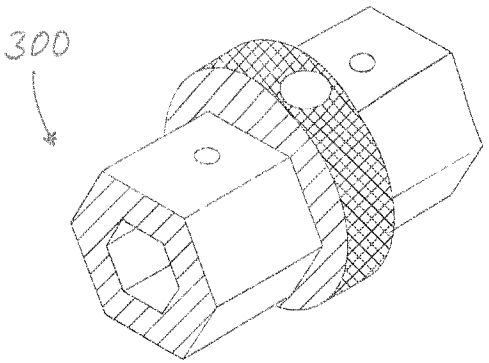
Figure 48:
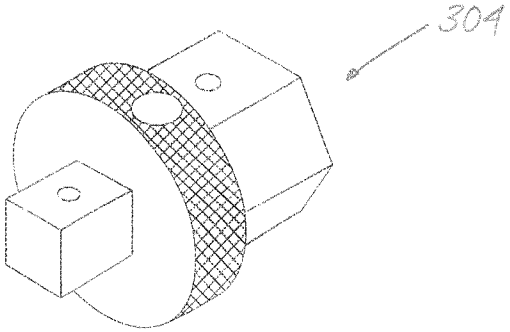
Figure 47:
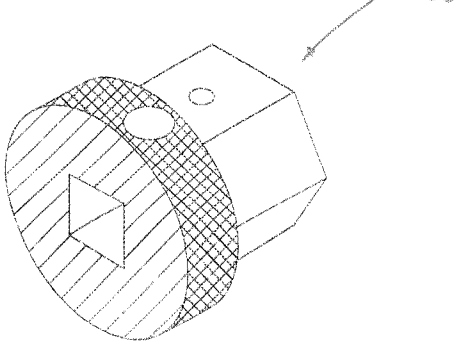

FIGS. 45-60 illustrate various embodiments of socket adapters. The embodiments of FIGS. 45 and 46 include adapters 300 opposing ends having differently shaped sockets, and may incorporate the mechanisms of FIGS. 27A and 27B to provide a retaining and quick release function. FIG. 47 shows an adapter 302 for converting a hexagonal socket into a square one, while FIG. 48 shows an adapter 304 for converting a female socket to a male one.

Figure 50:
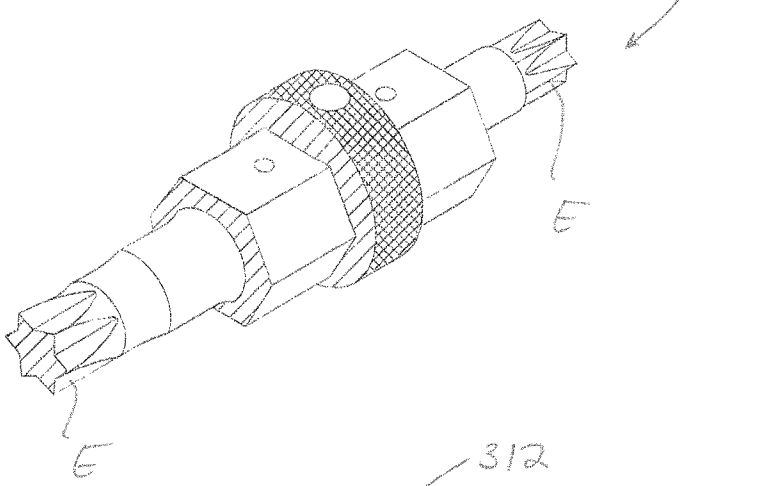
Figure 49:
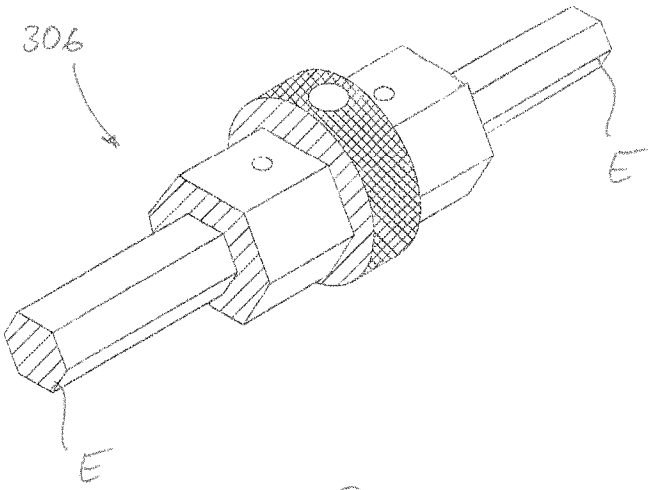
Figure 52:
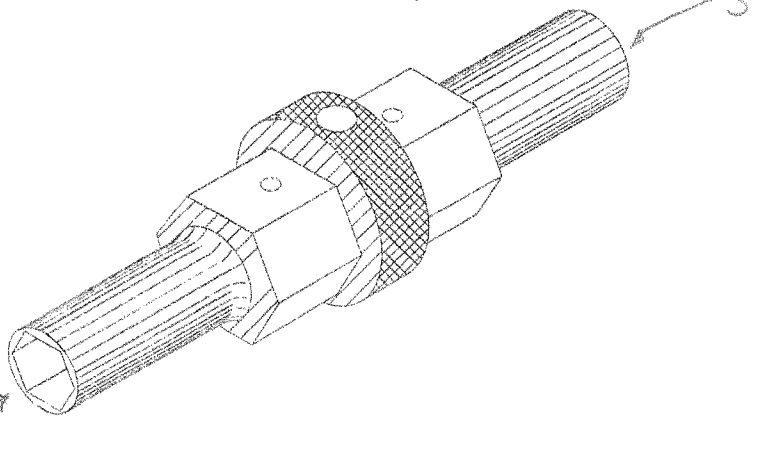
Figure 51:
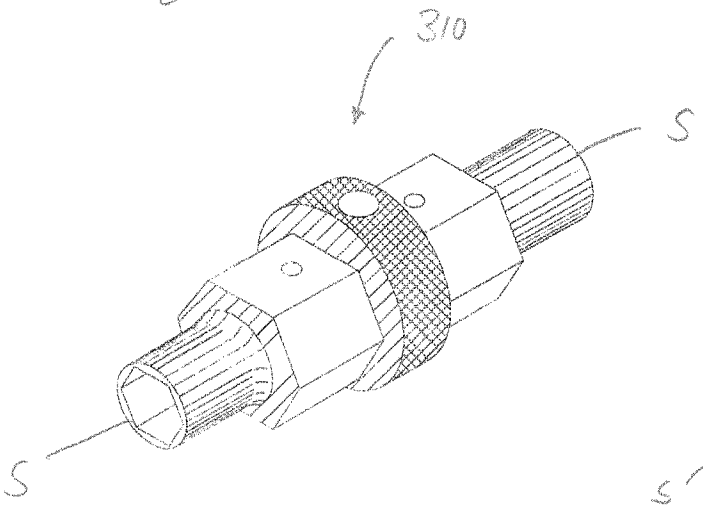
Figure 58:
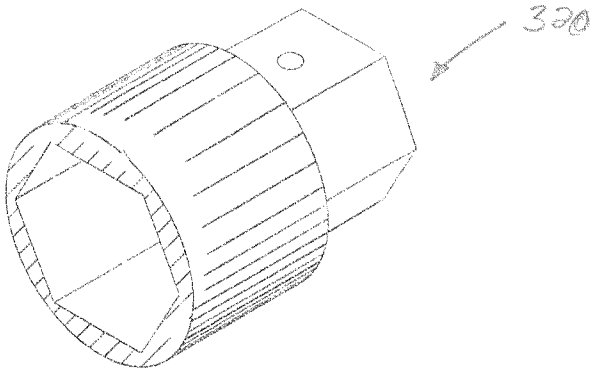
Figure 60:
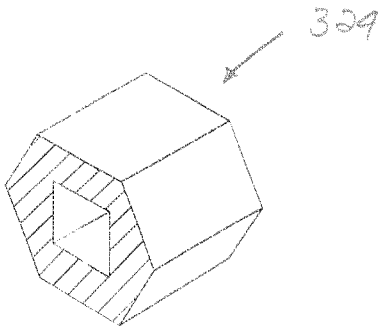
Figure 57:
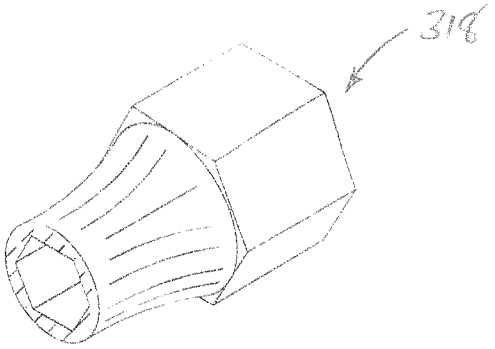
Figure 59:
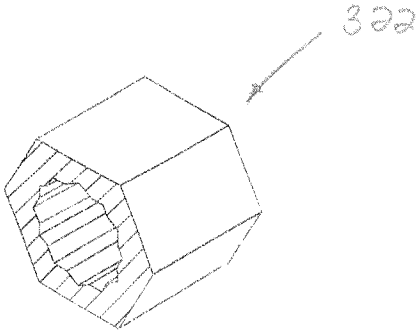

FIGS. 49 and 50 show adapters 306, 308 having different sizes of working elements E, while FIGS. 51 and 52 show reversible adapters 310, 312 providing different sizes of sockets S. FIGS. 53-60 also show "one way" adapters 310-324 with different ends (sizes and shapes) to adapt an existing socket for various uses.

The foregoing descriptions of various embodiments have been presented for purposes of illustration and description. These descriptions are not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

The invention claimed is:

1. An apparatus for use in rotatably driving a working element using a tool having a handle and a driver for driving the working element, the apparatus comprising:

an elongated shaft including a first end having a female socket adapted for engaging the driver of the tool and a second end having a male element adapted for slidably receiving the working element, the male element including a square cross section and a ball adapted to engage the working element;

an elongated, tubular housing carried by the shaft external to the tool, said tubular housing having a proximal end corresponding to the first end of the shaft and a distal end corresponding to the second end of the shaft, each of said ends is provided with a counter bore;

a first roller bearing located within the proximal counter bore, the first roller bearing including an opening for press-fittingly receiving the shaft, the first roller bearing retained within the proximal counter bore by an outer surface of the first roller bearing, and a second roller bearing located within the distal counter bore, the second roller bearing including an opening for press-fittingly receiving the shaft, the second roller bearing retained within the distal counter bore by an outer surface of the second roller bearing, said first and second roller bearings adapted for providing low friction, rotatable support for the tubular housing relative to the shaft and the tool; and one snap ring adapted to retain the housing in position over at least a portion of the shaft and to restrain the second roller bearing in the distal counter bore, said at least one snap ring located between the second end of the elongated shaft and the distal counter bore, and wherein the first roller bearing within the proximal counter bore is restrained by either an enlarged head of said female socket or by a second snap ring.

2. The apparatus of claim 1, wherein the housing extends from adjacent the first end of the shaft to adjacent the second end of the shaft.

3. The apparatus of claim 1, wherein the female socket includes a portion having an outer diameter greater than an outer diameter of the housing defining said enlarged head.

4. The apparatus of claim 1, wherein the first roller bearing is restrained by a second snap ring is located in a shallow groove of the of proximal end.

5. The apparatus of claim 1, wherein the female socket is adapted for slidably engaging the driver of the tool.

6. The apparatus of claim 1, wherein a portion of the shaft is substantially flush with a portion of the housing.

7. An apparatus for use in rotatably driving a working element using a tool having a handle and a driver for driving the working element, the apparatus comprising:

an elongated shaft including a first end having a female socket adapted for engaging the driver of the tool and a second end having a male element adapted for slidably receiving the working element;

an elongated, tubular housing carried by the shaft external to the tool, said tubular housing having a proximal end and a distal end, each of said ends is provided with a counter bore;

a first roller bearing located at the proximal end, the first roller bearing including an opening for receiving the shaft, the first roller bearing retained within the proximal counter bore by an outer surface of the first roller bearing, and a second roller bearing located at the distal end the second roller bearing including an opening for receiving the shaft, the second roller bearing retained within the distal counter bore by an outer surface of the second roller bearing, said first and second roller bearings adapted for providing low friction, rotatable support for the tubular housing relative to the shaft and the tool;

a first round collar located at the proximal end between the female socket and the first roller bearing, the first collar ring having an inner surface with an opening extending through its longitudinal axis for receiving the shaft and an outer surface, the first collar ring including at least one setscrew protruding through the outer surface and the inner surface to make pressure contact with the shaft affixing the collar ring to the shaft to assist in preventing the first roller bearing from axial movement, and a second round collar located at the distal end between the male element and the second roller bearing, the second collar ring having an inner surface with an opening extending through its longitudinal axis for receiving the shaft and an outer surface, the second collar ring including at least one setscrew protruding through the outer surface and the inner surface to make pressure contact with the shaft affixing the collar ring to the shaft to assist in preventing the second roller bearing from axial movement.

8. The apparatus of either claim 1 or claim 7 in combination with a tool, wherein the tool comprises a handle for being gripped by a hand of a user and a driver for driving a working element.

* * * * *